US007144186B1

(12) United States Patent
Nolte

(10) Patent No.: US 7,144,186 B1
(45) Date of Patent: Dec. 5, 2006

(54) MASSIVE SECURITY BARRIER

(75) Inventor: Roger Allen Nolte, Jackson, MO (US)

(73) Assignee: Kontek Industries, Inc., New Madrid, MO (US)

( * ) Notice: Subject to any disclaimer, the term of this patent is extended or adjusted under 35 U.S.C. 154(b) by 0 days.

(21) Appl. No.: 10/951,951

(22) Filed: Sep. 28, 2004

(51) Int. Cl.
*E01F 13/00* (2006.01)
*E01F 15/00* (2006.01)
*E01F 15/02* (2006.01)
*E01F 15/04* (2006.01)

(52) U.S. Cl. ..... 404/6; 256/13.1

(58) Field of Classification Search ..... 404/6–10; 256/13.1
See application file for complete search history.

(56) References Cited

U.S. PATENT DOCUMENTS 3,126,671 A * 3/1964 Nagel ..... 52/223.6
3,732,653 A * 5/1973 Pickett ..... 52/71
3,807,699 A * 4/1974 France ..... 256/13.1
4,111,401 A * 9/1978 Pickett ..... 256/13.1
4,113,400 A 9/1978 Smith
4,828,425 A * 5/1989 Duckett ..... 404/6
4,844,652 A 7/1989 Schroughan
4,986,042 A 1/1991 Richardt
5,011,325 A 4/1991 Antonioli
5,074,704 A 12/1991 McKay
5,123,773 A 6/1992 Yodock
5,134,817 A 8/1992 Richardt
5,149,224 A 9/1992 Smith
5,156,485 A 10/1992 Ivey et al.
5,286,136 A * 2/1994 Mandish et al. ..... 404/6
5,292,467 A 3/1994 Mandish et al.
5,443,324 A 8/1995 Sullivan
5,464,306 A 11/1995 Cristiano
5,605,413 A * 2/1997 Brown ..... 404/6
5,752,691 A * 5/1998 Bashon et al. ..... 256/35
5,860,762 A * 1/1999 Nelson ..... 404/6
5,975,793 A * 11/1999 Simmons et al. ..... 404/6
6,164,865 A 12/2000 McCallum
6,203,242 B1 * 3/2001 Englund ..... 404/6
6,413,009 B1 7/2002 Duckett
6,474,904 B1 * 11/2002 Duckett et al. ..... 404/6
6,767,158 B1 7/2004 Consolazio et al.

(Continued)

OTHER PUBLICATIONS

Oregon Department of Transportation, "Precast Single Slope Concrete Barrier", Current Drawings—Standard Details: "DET144", Jun. 23, 2003, (above drawing is on Internet at http://egov.oregon.gov/ODOT/HWY/ENGSERVICES/docs/pdf/det-eng/e_detail144.pdf).

*Primary Examiner*—Raymond Addie
(74) *Attorney, Agent, or Firm*—Barclay J. Tullis

(57) ABSTRACT

Barrier elements couple together into a longitudinal wall to provide security from terrorist threats by being able to withstand both vehicle collisions and explosive blasts. Each barrier element is prefabricated to include a massive block of durable material, preferably high strength concrete, cast about one or more beams that are preferably made of steel and extend longitudinally through the block. Multiple blocks are positionable on top of the ground with their beams coupled longitudinally to one another, end-to-end. Forces from a vehicle collision or an explosive blast can cause barrier elements to rotate relative to one-another when the couplings between beams hinge or bend as the durable material that interferes with the rotation breaks away. The barrier elements are transportable by truck, positionable using readily available heavy lifting equipment, and longitudinally inter-connectable hingedly or rigidly by means of field-installable mechanical fastening hardware.

29 Claims, 6 Drawing Sheets

U.S. PATENT DOCUMENTS

2002/0025221 A1* 2/2002 Johnson ..... 404/6
2003/0161683 A1* 8/2003 Lembo ..... 404/6
2003/0223812 A1* 12/2003 Vandenbossche ..... 404/6
2004/0146345 A1* 7/2004 Consolazio et al. ..... 404/6
2004/0146347 A1 7/2004 Davis et al.
2005/0152744 A1* 7/2005 Straub ..... 404/6

* cited by examiner

MASSIVE SECURITY BARRIER

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

1. Field of the Invention

This invention relates to passive barrier elements located on the ground to establish a longitudinal wall that can provide security from terrorist threats by at least slowing, and preferably stopping in a short distance, a vehicle that collides with it, and by providing at least partial protection against blast wave forces, thermal energy, and flying debris from a nearby explosion event.

2. Description of the Related Art

Security zones for protecting sensitive groups of people and facilities, be they private, public, diplomatic, military, or other, can be dangerous environments for people and property if threatened by acts of terrorism. Ground anchored active anti-ram vehicle barriers, bollards, and steel gates may stop a vehicle but do little against a blast wave or blast debris. Earthen berms, sand-filled steel walls, massive concrete or plate steel walls anchored into the ground, or concrete panels laminated with steel sheeting and anchored into the ground have been used to shield against both terrorist vehicles and bombs. But none of these ground-anchored barriers are portable for ease of relocation. Massive barriers of concrete made in segments have traditionally not been strongly coupled together and therefore cannot support high enough tensile forces required to keep a wall from opening up under the force of a straight-on vehicle collision.

Historically, the design of longitudinal barrier systems has focused primarily on issues such as vehicle redirection capability alongside and in divider sections of highways, minimization of vehicle intrusion into a work zone where the vehicle strikes the barrier at a grazing angle, and portability. Many of these barrier systems must be capable of redirecting a variety of different types of vehicles in a smooth and stable manner without causing vehicle rollover; some of these barriers have achieved their design criteria by having high profiles with substantial mass. But the temporary nature of most work zones requires that a barrier system be lightweight and portable so that the barriers can be installed, repositioned, and removed with minimal effort.

Although not relevant to blast protection or stopping straight-on vehicle collisions, some examples of highway barrier wall elements are to be found in the following US patents. U.S. Pat. No. 6,767,158 to a "Portable Roadway Barrier" discloses a low-profile barrier formed from an elongated body having an impact surface, a first structure with a key and keyway for fitting adjacent barriers end-to-end to withstand orthogonal and compression forces, and a second structure having support brackets for transferring tensile forces to adjacent barriers, wherein the brackets on adjacent barriers are interconnected with a longitudinally oriented threaded pin. This U.S. Pat. No. 6,767,158 requires the first structure to lie between the second structure and the impact surface. U.S. Pat. No. 5,292,467 to a "Highway Barrier Method" discloses an energy absorbing roadway barrier for dissipating kinetic energy upon impact by a moving vehicle. That barrier has an elongated core of high-density concrete that is anchored to the ground. It has a core that includes prestressed steel rebar members as well as a possibly unstressed central rebar that protrudes from the ends where it can be clamped to those of longitudinally adjacent barriers using a pair of clamping members clamped only to the outside of the rebar. The core is surrounded by a light-weight mixture of cement and sand mixed with such things as polymers and fiberglass. US Patent Application Publication No. 2004/0146347 and U.S. Pat. Nos. 6,413,009; 6,164,865; 5,464,306; 5,443,324; 5,156,485; 5,149,224; 5,134,817; 5,123,773; 5,074,704; 5,011,325; 4,986,042; 4,844,652; and 4,113,400 all disclose various means of keying and/or linking barrier or curbing modules together. U.S. Patent Application Publication No. 2004/0146347 also discloses a plurality of external and continuous cables running the length of the barrier system with which to accommodate longitudinal tension along the entire barrier system. But none of these references include or suggest including core longitudinal beam elements suitable for accommodating high tensile stress with little strain longitudinally throughout a row of barrier elements, or include or suggest providing coupling means to link such beam elements in manners that provide for the coupling means to absorb significant energies in shearing and/or bending. U.S. Patent Publication No. 2004/0146347, in particular, neither discloses nor suggests a motivation or means to enable one barrier element to transfer roll-producing torque about its longitudinal axis to an adjacent barrier element.

None of these barrier systems have focused on protection of a safe side of a barrier wall from encroachment by a high-speed vehicle striking the opposite side of the wall head-on or otherwise at angles that are nearly perpendicular to the wall, and particularly not with portable barrier elements not anchored into the ground. And none of these barrier systems have also focused on the issues of simultaneous protection from both vehicles and explosive blasts.

Forces directed perpendicularly to the longitudinal direction of a continuous wall not firmly tied into the ground, or forces directed at other large angles to the longitudinal direction, must be counteracted both with resisting inertial forces and with longitudinal reaction forces that are many times higher than the applied forces. In order to resist being displaced too far sideways, even a massive wall must absorb energy by converting kinetic energy (mechanical or aerodynamic), directed perpendicularly or otherwise obliquely to the wall, into other forms of energy, without suffering too much longitudinal strain or lateral shear. Some of the kinetic energy directed against one part of a wall can be transformed to less threatening kinetic energies directed in other directions and at other parts of the wall. Some of the energy can be absorbed as work done to break apart the materials of the wall, preferably without opening up a break in the wall itself, to permanently stretch and distort the wall, and to crush parts of the colliding vehicle. And some of the kinetic energy can be converted to heat created by friction between the parts of the wall, or through pushing, pulling, and dragging of the wall along the ground. Other forms of energy absorption are potential energies of elastic shearing and bending within the wall elements and within the wall system. Another is the conversion of translational kinetic energy into rotational kinetic energy of barrier elements (about vertical and horizontal axes). What is needed is a barrier wall system that exploits all of these energy absorption mechanisms to the best advantage, and in a manner that won't itself endanger life and property.

The kinetic energy involved in a 9,000 kilogram (19,845 lbm) truck traveling at 80 kilometers/hour (49.71 ml/hr) is approximately 2,266,000 joules of energy (approximately 1,671,000 ft-lbf), which is approximately the work performed by one horse in an 0.8442 of an hour (50 minutes and 39 seconds), or approximately 0.6296 of a kilowatt-hour. The energies from a nearby explosion can be even more significant and require a strong and robust wall to withstand being moved significantly or otherwise being blown apart. A thousand kilograms of TNT explosive (0.9842 of a ton of TNT) produces approximately 1,845 times the energy of the aforementioned truck. But the energy of exploding that much explosive material may not be as directed as that of a truck, if not ignited too closely to the wall. The shock wave and ensuing high pressures and temperatures, and the high-velocity rush of gas and blast debris, are diminished at any one location away from the blast by virtue of their being spread out over a greater volume of space. For example, if the above explosive were discharged 5 meters from a barrier wall, it could produce an energy, at an area of wall equivalent to that of the frontal area of a truck (approximately 2 meter by 1 meter), of more than 26.6 Megajoules (11.7 times as much as the truck) although with far less inertial mass.

Thus, a need exists for a better barrier wall design than that which uses conventional low or high profile barriers. A need exists for barrier walls that can withstand both head-on collision forces of speeding terrorist vehicles and explosive blasts, and at the same time be rapidly and cleanly deployable and removable. In addition, these walls need to be low cost to manufacture, ship, install, and remove. And they must not endanger underground utilities when being deployed or removed.

BRIEF SUMMARY OF THE INVENTION

The invention is pointed out with particularity in the appended claims. However, at least some important aspects of the invention are summarized herein.

The current invention is that of a massive barrier element and a security wall constructed by coupling or otherwise linking two or more such elements longitudinally end-to-end to form a longitudinal wall that can provide security from terrorist threats by being able to withstand both vehicle collisions and explosive blasts. Each barrier element is prefabricated to include a massive block of durable material, preferably high strength concrete, cast about one or more beams (also called "tie-bars") that are preferably made of high strength steel and each extending longitudinally though the block. Within this specification or disclosure, the term "tie-bar" means a beam that extends longitudinally end-to-end through a massive security barrier element and is used to connect to one or two adjacent massive barrier elements. Each beam or tie-bar has a cross-sectional area greater than that of an ordinary rebar rod as typically used to reinforce concrete structures. Multiple blocks of this type can be positioned on top of the ground with their beams coupled longitudinally to one another, end-to-end as in a chain, to establish a protective barrier wall. Such a wall can withstand great longitudinal tension, can resist being rolled, and can absorb and endure great amounts of mechanical and thermal energy. When loaded laterally (and horizontally), such as by forces from a nearby explosive blast or by a collision from a moving vehicle, such a wall can act as a structural beam, with at least one chain of tie-bars in tension, and with the concrete in compression on the side of the wall facing the blast or vehicle. With sufficient tensile strength in a chain of tie-bars, vertical edges of the concrete in compression can be designed to fail by absorbing significant energy, and as a result, adjacent barrier elements can rotate or hinge relative to one-another. The barrier elements can be transported by truck, positioned at a security site by using readily available heavy lifting equipment, and can be longitudinally interconnected hingedly or rigidly by means of field-installable mechanical fastening hardware. The invention does not require ground-penetrating anchoring devices, so installation, relocation, and later removal does not endanger underground utilities.

One of the embodiments of the invention is a method for providing protection from a terrorist threat, the method comprising the steps of: a) providing multiple barrier elements each comprising a mass of solid material that comprises two opposite sides, wherein each of said barrier elements includes at least one tie-bar that has two opposite ends and that extends through its mass of solid material from one side of its barrier element to its opposite side, wherein a mid-portion of the tie-bar is cast within the solid material, wherein each end of the tie-bar extends through a cavity in a respective one of the sides, wherein each barrier element is alignable side-against-side in a continuous row with another of the barrier elements, and wherein each pair of barrier elements that are to be aligned adjacent to one-another then forms an adjacent pair; b) providing at least one respective coupling means, for each of said adjacent pairs, for rotatably attaching at least the one tie-bar of one of the barrier elements of the adjacent pair to a respective at least one tie-bar of the other barrier element of the adjacent pair end-to-end to form a coupled pair of tie-bars; and c) aligning said adjacent pairs and installing each of said respective coupling means to form said continuous row between an expected safe side and a threat side; wherein the coupling means and the coupled ends of tie-bars are generally hidden within the cavities from being exposed to blast products from a terrorist's explosion; and wherein each of said coupled pairs of tie-bars has sufficient strength that two adjacent barrier elements rotate relative to one-another as they slide and remain coupled when there is sufficient external force from terrorist acts to break the solid material of the two adjacent barrier elements where the solid material interferes with rotation. Each of a pair of the sides that are against one-another between said adjacent barrier elements can include a generally planar surface that extends generally parallel and oppositely facing to a generally planar surface of the other of the pair of sides, and extends both toward a front and toward a back of said barrier elements.

Another embodiment of the invention is a security wall segment comprising: a) a first massive security barrier element, for deterring terrorists, comprised of a first tie-bar and a second tie-bar each cast within a first mass of solid material, wherein at least a portion of each of the tie-bars has a rectangular cross-section, wherein each of said first and second tie-bars have two opposite exposed ends extending outward from respectively two cavities within respectively two generally planar side surfaces of said first mass of solid material, wherein each of the exposed ends has a hole with an approximately vertical hole axis that lies at least partially and approximately coincident with its respective generally planar side surface, and wherein the first barrier element is slidable; b) a second massive security barrier element, for deterring terrorists, comprised of a third tie-bar and a fourth tie-bar each cast within a second mass of solid material and each of the tie-bars having a rectangular cross-section, wherein each of said third and fourth tie-bars have two opposite exposed ends extending outward from respectively two cavities within respectively two generally planar side surfaces of said second mass of solid material, wherein each of the exposed ends has a hole with an approximately vertical hole axis that lies at least partially and approximately coincident with its respective generally planar side surface, and wherein the second barrier element is slidable; and c) coupling means for attaching said first and second tie-bars respectively to said third and fourth tie-bars, wherein said coupling means provides rotatable coupling between the first and second barrier elements about a rotational axis that is at least approximately coincident with at least one of said approximately vertical hole axes from the first barrier element and at least one of said approximately vertical hole axes from the second barrier element, and wherein said coupling means and the tie-bars are of sufficient strength to remain attached during rotation of the first barrier element relative to the second barrier element; wherein at least the tie-bars remain within most of the masses of solid material and remain attached by the coupling means after at least one of the massive security barrier elements is subjected to external impulsive forces sufficiently strong to rotate the modules relative to each other causing at least some of the solid material that structurally interferes with that rotation to break. This embodiment can further including additional massive security barrier elements. The holes at the exposed ends of at least one of the tie-bars can be within a strip of steel extending continuously between them. The masses of solid material can be masses of concrete. Each of said first and second massive security barrier elements can include a bottom surface that is slidable, a front surface, and a back surface. The coupling means between barrier elements can hinge horizontally when either a terrorist vehicle or an explosive blast strikes one of the front surfaces or one of the back surfaces. At least one approximately vertical edge is formed between a front surface and a side surface on one of the barrier element; and the approximately vertical edge can be damaged by rotation when a terrorist vehicle or an explosive blast strikes at least one of the front surfaces.

Another embodiment of the invention is a massive security barrier module comprising: a) a mass of solid material having a slidable bottom surface, wherein the mass has two opposite sides, a front, and a back, wherein each side has a front edge near the front, and wherein each side has a back edge near the back; b) at least two tie-bars cast within the mass, wherein each of said at least two tie-bars extends through the mass and into a respective cavity in each of said two opposite sides; and c) a coupling means for attaching said at least two tie-bars to other tie-bars of an adjacent mass of a similar massive security barrier module, wherein the coupling means has an axis of rotation that lies generally between the front edge and the back edge of one of the sides, wherein the axis is at least partially and approximately coincident with one of said two opposite sides, and wherein the coupling means and tie-bars are of sufficient strength to remain attached under rotation of the coupling means; wherein the massive security barrier module, has sufficient strength to maintain attachment with the similar massive security barrier module, and the axis remain at least partially and approximately coincident with said one of said two opposite sides, when at least one of the massive security barrier modules is subjected to an external impulsive force from a terrorist act sufficiently strong to rotate the modules relative to one another and cause at least one of the edges that structurally interferes with that rotation to break; whereby energy from a security-threat event is absorbed by the break and further attenuated by the mass sliding across the ground.

Another embodiment of the invention is a first massive security barrier element comprising: a) a first mass of solid material, wherein the mass has a slidable bottom surface, has at least a first cavity within a first side surface, and has a second cavity within a second side surface, wherein said first side surface is generally planar defining a first planarity plane, wherein said second side surface is generally planar defining a second planarity plane, and wherein the first and second side surfaces are at least approximately perpendicular to the bottom surface; b) a first tie-bar having a first end and a second end defining a first longitudinal axis of elongation, wherein said first tie-bar has a first mid-portion between said first end and said second end, wherein said first tie-bar is penetrated near said first end by at least a first attachment hole having a first hole axis, wherein said first tie-bar is penetrated near said second end by at least a second attachment hole having a second hole axis, and wherein said first hole axis and said second hole axis are both oriented at least approximately perpendicular to the first longitudinal axis; and c) a second tie-bar having a third end and a fourth end defining a second longitudinal axis of elongation, wherein said second tie-bar has a second mid-portion between said third end and said fourth end, wherein said second tie-bar is penetrated near said third end by at least a third attachment hole having a third hole axis, wherein said second tie-bar is penetrated near said fourth end by at least a fourth attachment hole having a fourth hole axis, and wherein said third hole axis and said fourth hole axis are both oriented at least approximately perpendicular to the second longitudinal axis; wherein said first mid portion and said second mid portion are cast within said first mass of solid material; wherein at least said first mid portion is that of a straight single bar of solid construction; wherein said first end is spaced apart by a spacing distance from said third end at least in a direction at least approximately perpendicular to said bottom surface; wherein said second end is spaced apart by approximately the same spacing distance from said fourth end at least in a direction at least approximately perpendicular to said bottom surface; wherein at least said first tie-bar penetrates both said first cavity and said second cavity and extends beyond the planarity planes defined by the first and second side surfaces; wherein the first and third hole axes are at least approximately co-incident and form a first axis of rotation that is at least approximately coincident with the first planarity plane; wherein the second and fourth hole axes are at least approximately co-incident and form a second axis of rotation that is at least approximately coincident with the second planarity plane; and wherein the first and second axes of rotation are for hinged attachment side-against-side of the first massive security barrier element to adjacent and similar massive security barrier elements to form a security barrier having sufficient strength and mass collectively to stop a terrorist vehicle in a short distance of sliding, to absorb energy in breaking solid material that interferes with rotation, and to prevent a terrorist blast from breaking the elements loose from each other. Each tie-bar can be a bar of generally rectangular cross-section and elongated from end-to-end in a direction generally parallel to their respective longitudinal axis of elongation. The tie-bars can be comprised of steel, and the mass of solid material can be comprised of concrete.

A rebar cage within the mass of solid material can encircle the tie-bars. The mass of solid material can have a generally planar bottom.

The embodiment described in the previous paragraph may further comprise: a) coupling means for attaching said second end of said first tie-bar rotatably to a first end of another first tie-bar of a second massive security barrier element similar to the first barrier element to form a coupled pair of adjacent barrier elements each having their respective mass of solid material with their respective front surface and their respective back surface; and b) breakable vertical edges of each of the masses of solid material, wherein the edges are at least approximately vertical and are situated at each intersection of one of its side surfaces with one selected from the group consisting of its respective front surface and its respective back surface; wherein the attached tie-bars are coupled with sufficient strength to remain attached when rotation of the first barrier element relative to the second barrier element causes at least some of the solid material to break; whereby the coupling means and the breakable vertical edges allow said second massive security barrier element to rotate horizontally relative to said first massive security barrier element and about the second axis of rotation of said first massive security barrier element; and whereby horizontal rotation can occur while the tie-bars, together with their coupling means, remain intact after at least one of the coupled pair of adjacent barrier elements is struck by a colliding vehicle or exposed to energy from a nearby explosive blast. The coupling means can include a drop-pin extended through at least the second and fourth attachment holes; or the coupling means can include a bolt and a nut wherein said bolt extends through at least the second attachment hole of the first massive security barrier element and the first attachment hole of the second massive security barrier element.

Another embodiment of the invention is a security wall comprising: a) a row of massive security barrier elements that are slidable, wherein each of the barrier elements comprises at least two tie-bars and a mass of solid material that has two opposite and generally planar sides, wherein the mass of solid material of each of the barrier elements is cast about its respective two tie-bars, wherein each of the respective two tie-bars extends between the two generally planar sides of its corresponding mass of solid material, wherein each adjacent pair of these barrier elements has two oppositely-facing generally planar sides located against one-another defining a common interface plane that is penetrated by each of the respective two tie-bars, and wherein each tie-bar that penetrates the interface plane is positioned partially within a pair of oppositely facing cavities that are respectively in the oppositely-facing generally planar sides; and b) for each adjacent pair of barrier elements, a coupling means for attaching the tie-bars of one of the pair of barrier elements to respective tie-bars of the other of the pair of barrier elements to establish an approximately vertical axis of hinged rotation, wherein the vertical axis is at least partially and approximately coincident with the respective interface plane; wherein the oppositely-facing generally planar sides located against one-another, together with the oppositely facing cavities that are respectively in the oppositely-facing generally planar sides, form a generally closed structure that hides and protects the included coupling means; wherein the strengths of the tie-bars and the coupling means are sufficient to withstand relative rotation between barrier elements of at least one of the adjacent pairs of barrier elements when the security wall is stuck by one selected from the group consisting of a terrorist vehicle and a terrorist explosion; and wherein solid material of at least one of the generally planar sides breaks under said rotation. In this embodiment, at least a portion of one of the tie-bars can be a beam of rectangular cross-section comprised of a single longitudinal strip of high-strength steel extending at least all the way between the two generally planar sides corresponding to one of the masses of solid material.

Another embodiment of the invention is a method for assembly of a coupled pair of adjacent massive security barrier elements comprising the steps of: a) providing a pair of adjacent massive security barrier elements, wherein each element is comprised of a respective mass of solid material comprised of two opposite sides and a slidable bottom surface, wherein each of the sides of each element is comprised of two opposite edges, wherein each element is comprised of a tie-bar partially encased within the respective mass of solid material and extending from one of the two opposite sides to the other of the two opposite sides of the respective mass of solid material, wherein the tie-bar of each element is located between the two opposite edges of each of the two opposite sides of the respective mass of solid material, and wherein the tie-bar of each element extends beyond the two opposite sides of the respective mass of solid material from respective cavities in the two opposite sides of the respective mass of solid material; b) providing a coupling means for attaching the tie-bar of one of the adjacent elements rotatably to the tie-bar of the other of the adjacent elements while the adjacent elements are located side-against-side; and c) using the coupling means to attach the two elements together rotatably side-against-side forming a coupled pair of adjacent massive security barrier elements and a coupled pair of tie-bars sufficiently strong to maintain attachment under rotation of one of the adjacent elements relative to the other element; wherein rotation between the elements of the coupled pair requires a sufficiently strong force to overcome compressive strength of at least some of the solid material and cause that some of the solid material to fail near at least one of the edges; and wherein the tie-bars remain coupled, when sustaining said rotation, and collectively remain provide a barrier to terrorist threats. This method can further comprise the steps of: a) providing an additional massive security barrier element similar to one of the coupled pair; b) providing an additional coupling means similar to that coupling the coupled pair; c) using the additional coupling means to attach the additional element rotatably to one other of the barrier elements that hasn't been coupled twice; and d) repeating the previous three steps at least one time.

Another embodiment of the invention is a method for assembling and using a coupled pair of massive security barrier elements comprising the steps of: a) identifying what is to be a safe side opposite to a threat side, said safe side to be protected by a row of the barrier elements from at least one selected from the group consisting of a terrorist's vehicle in a threat region and a terrorist's explosive in a threat region; b) providing slidable massive security barrier elements each having a respective mass of solid material with respective two opposite sides, each side bounded by at least a vertical edge, each of the elements having at least two tie-bars partially encased within its respective mass, each tie-bar extending between and through the two opposite sides of the respective mass, and each tie-bar having two opposite ends and with a hole in each end, wherein each of the holes has an approximately vertical hole axis at least partially and approximately coincident with a side; and c) placing the barrier elements adjacent to one-another to form the row and coupling them with one of the group consisting of a drop-pin and a bolt extending through at least two of the holes, wherein a gap between the barriers is smaller than a diameter of the drop-pin or bolt; wherein rotation between the barrier elements of the coupled pair requires a sufficiently strong external force to overcome compressive strength of at least some of the solid material and cause that some of the solid material to fail near at least one of the vertical edges; and wherein the barrier elements remain coupled, when sustaining said rotation, and collectively provide a barrier to terrorist threats.

Another embodiment of the invention is a method for assembling and using a massive security barrier wall comprising the steps of: a) providing a location for the wall where one side of the wall is to be a safe side and an opposite side of the wall is allowed to be a threat side, wherein the safe side provides protection from at least one selected from the group consisting of a terrorist's vehicle on the threat side and a terrorist's explosive on the threat side; b) providing multiple massive security barrier elements each having a respective mass of solid material with respective two opposite sides and a slidable bottom surface, each element having at least two tie-bars encased within its respective mass of solid material and extending between and through its opposites sides, and each tie-bar having two opposite ends and a hole near each end, wherein each of the holes has an approximately vertical hole axis at least partially and approximately coincident with a side; and c) arranging the barrier elements into a row at said location to form the wall, and using one of the group consisting of drop-pins and bolts to couple tie-bars of adjacent barrier elements, wherein gaps between masses of solid material that are adjacent to one-another are somewhere less than a smallest width of the holes so used; wherein rotation between the barrier elements requires a sufficiently strong external force to overcome compressive strength of at least some of the solid material and cause that some of the solid material to fail near at least one vertical edge; and wherein the barrier elements remain coupled, when sustaining said rotation, and collectively provide a barrier to terrorist threats.

A massive security barrier wall comprising: a) a pair of massive security barrier elements each comprising: i) a mass of solid material having a slidable bottom surface and two side surfaces having at least one vertical edge, wherein the side surfaces are spaced apart to define a length of the mass; ii) at least one rectangular-cross-sectioned tie-bar extending through the mass at least from one side surface to the other side surface; b) a coupling means for coupling an end portion of the tie-bar of one of the barrier elements to an end portion of the tie-bar of the other barrier element such that one of the sides of one of the masses is at least approximately against a side of the other of the masses; wherein the coupling means enables an initial hinged rotation of one barrier element relative to the other barrier element of more than a nominal amount only when sufficiently strong external forces cause at least some of the mass of solid material to break under compression about the edges; and wherein the tie-bars are of sufficient strength to remain coupled during said rotation, thereby maintaining a barrier to terrorist threats.

Another embodiment of the invention is a method for using a massive security barrier element comprising the steps of: a) identifying a safe side to be protected from at least one selected from the group consisting of a terrorist's vehicle on a threat side and a terrorist's explosive event on a threat side; b) providing a slidable massive security barrier element having a mass of solid material, having at least one tie-bar extending through two opposite and co-parallel sides of the mass, and having a hole in each of two ends of the tie-bar, wherein each of the holes has an approximately vertical hole axis at least partially and approximately coincident with a respective one of the sides enabling hinged attachment to another tie-bar in a similar and adjacent massive security barrier element; c) using a means for attaching the one tie-bar to said another tie-bar hingedly; and d) placing the element side-against-side with said similar and adjacent massive security barrier element and between the safe side and the threat side to anticipate a sliding distance of the element along with the adjacent element; wherein the tie-bars and the means for attachment are protected from a terrorist's explosive blast by at least partial encasement within the solid material; and wherein both the means for attachment and the tie-bars are strong enough to remain attached to each other when rotation of the element relative to the adjacent element id forced by one selected from the group consisting of a collision with a terrorist vehicle and a blast from a terrorist explosion, causing solid material to break where the solid material interferes with the rotation.

Objects and Advantages of the Invention

Objects and advantages of the present invention include a security barrier element (also called a "barrier element") that is all at once massive, durable to vehicle collisions durable to explosive blasts, energy absorbing, portable, inexpensive to manufacture, inexpensive to deploy, inexpensive to relocate, inexpensive to remove, able to be firmly coupled to adjacent barrier elements, able to transfer rotational forces to adjacent barrier elements, able to transfer longitudinal tension forces to adjacent barrier elements, able to transfer compressive forces to adjacent barrier elements, resistant to rolling, resistant to sliding, has a high coefficient of friction with the ground (or other supporting surface), available in a variety of architectural designs and surface appearances, providing of mounting fixtures for flags and cameras and the like, providing of chases or conduits for utilities, and non threatening to utilities located below the ground.

The same objects and advantages of the invention that apply to a single barrier element extend to barrier walls constructed by coupling adjacent barrier elements to one another in a longitudinal end-to-end row of barrier elements. Important parts of the invention and its preferred embodiments include coupling means for attaching tie-bars end-to-end singly or in pairs. The term "end-to-end" is intended to be interpreted herein to include such arrangements of two beams as "butt-end to butt-end", having overlapped ends, having interleaved ends, and any other equivalent structural means for two beams that, when attached together in that arrangement, form a combination beam of extended length that will support tension (or compression or shear) in reaction to forces applied at opposite ends of their combined length.

Further advantages of the present invention will become apparent to the ones skilled in the art upon examination of the drawings and detailed description. It is intended that any additional advantages be incorporated herein.

The various features of the present invention and its preferred implementations may be better understood by referring to the following discussion and the accompanying drawings. The contents of the following discussion and the drawings are set forth as examples only and should not be understood to represent limitations upon the scope of the present invention.

BRIEF DESCRIPTION OF THE SEVERAL VIEWS OF THE DRAWINGS

The foregoing objects and advantages of the present invention for a massive security barrier element and walls of such elements may be more readily understood by one skilled in the art with reference being had to the following detailed description of several embodiments thereof, taken in conjunction with the accompanying drawings. Within these drawings, like reference numerals refer to like elements in the several figures, where alphabetic-letter-suffixes denote copies of a part or feature, where primes denote some lack of perfect duplication, and in which.

DETAILED DESCRIPTION OF THE INVENTION

Figure 1:
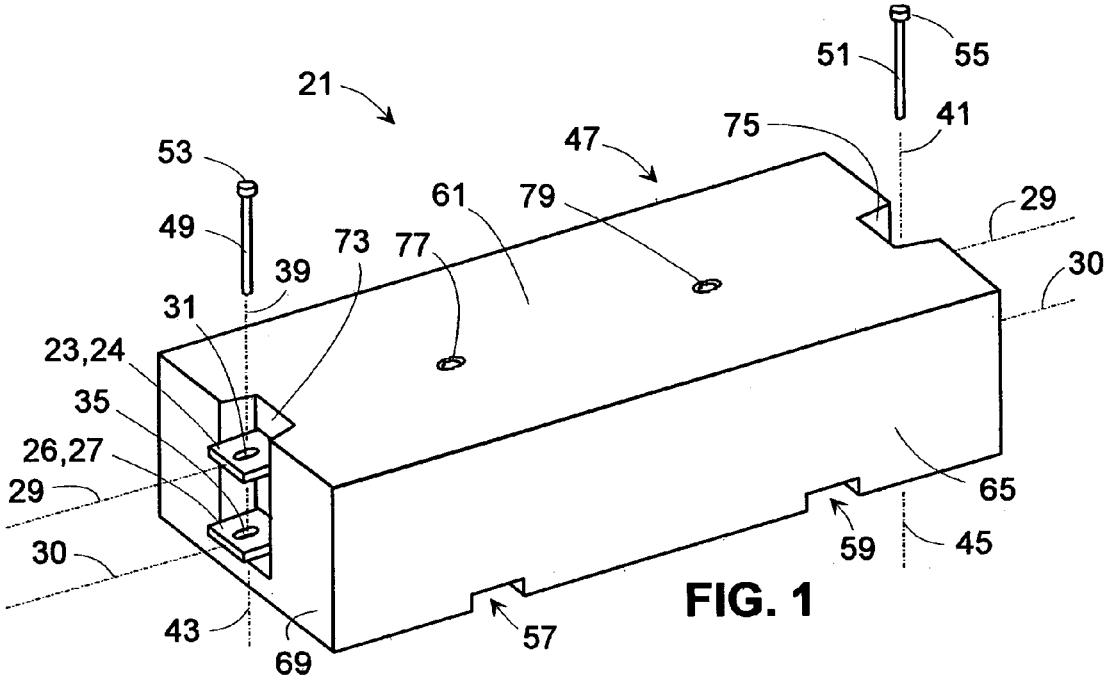
FIG. 1 shows a first embodiment of a massive security barrier element showing a mass of solid material and two of the exposed ends (tongues) of two tie-bars, and shows a drop-pin (as part of a first coupling means) for coupling each end of the barrier element to an adjacent barrier element.

The following is a detailed description of the invention and its preferred embodiments as illustrated in the drawings. While the invention will be described in connection with these drawings, there is no intent to limit it to the embodiment or embodiments disclosed. On the contrary, the intent is to cover all alternatives, modifications and equivalents included within the spirit and scope of the invention as defined by the appended claims.

FIG. 1 shows a first embodiment of a massive security barrier element 21 comprising a mass of solid material 47 surrounding a first tie-bar 23 and a second tie-bar 26. The two tie-bars or beams 23 and 26 have respectively a first longitudinal axis 29 and a second longitudinal axis 30 which are at least approximately parallel to one another (within about 6 degrees of parallelism). Note that the two tie-bars 23 and 26 are spaced apart from one another. The first tie-bar 23 is shown as having a first attachment hole 31 in an exposed first end or tongue 24 at the left side of the view. This first tie-bar 23 also has a second attachment hole 33 in a second end or tongue 25 (at the right-hand side of the view but not shown until FIG. 2) at an opposite end 25 longitudinally. The second tie-bar 26 is shown as having a third attachment hole 35 in an exposed first end or tongue 27 at the right-hand side of the view. This second tie-bar 26 also has a fourth attachment hole 37 in a fourth end or tongue 28 at an opposite end 28 longitudinally (at the right-hand side of the view but not shown until FIG. 3). (Note that the use of the adjectives "first", "second", "third", etc. within this patent specification are not intended as ordinal counts, but rather only as distinguishing labels.) The first and third attachment holes 31 and 35 have respective first and third hole axes 39 and 43 that are shown to be approximately co-axial for the purpose of receiving a drop-pin 49. The second and fourth attachment holes 33 and 37 have respective second and fourth hole axes 41 and 45 that are shown to be approximately co-axial for the purpose of receiving a drop-pin 51. Each drop-pin 49 and 51 can function to provide an axis of rotation in common with the axes of attachment holes it penetrates. Each drop-pin 49 and 51 is shown with a respective and optional head 53 and 55, and in this example embodiment is shown having no threads. Drop-pins 49 and 51 are preferably made of high-strength steel. Note that each of the attachment holes 31 and 33 is elongated parallel to longitudinal axis 29 (also shown in FIG. 2), and that attachment holes 35 and 37 are elongated parallel to longitudinal axis 30 (as shown in FIG. 3).

In regard to FIG. 1, the mass of solid material 47 is shown, as one example embodiment, shaped as a block 47 having a top surface 61, a bottom surface 63 (out of view), a front surface 65, a back surface 67 (out of view), and first and second end surfaces 69 and 71 (the second end surface 71 is out of view). The out-of-view surfaces 63, 67, and 71 are shown in one or both of FIGS. 2 and 3. The end surfaces 69,71 are also called side surfaces and are located at opposite ends of the mass of solid material 47, i.e. at opposite ends of the massive security barrier element 21. In this embodiment, all of the six surfaces are shown as generally planar. The first and third hole axes 39,43 are shown to be generally coincident with the planarity of the end surface 69. Similarly, second and fourth hole axes 41,45 are also generally coincident with the planarity of the end surface 71 (but out of view). This relative positioning of attachment holes in this and similar embodiments is shown also FIGS. 2–11.

Figure 5:
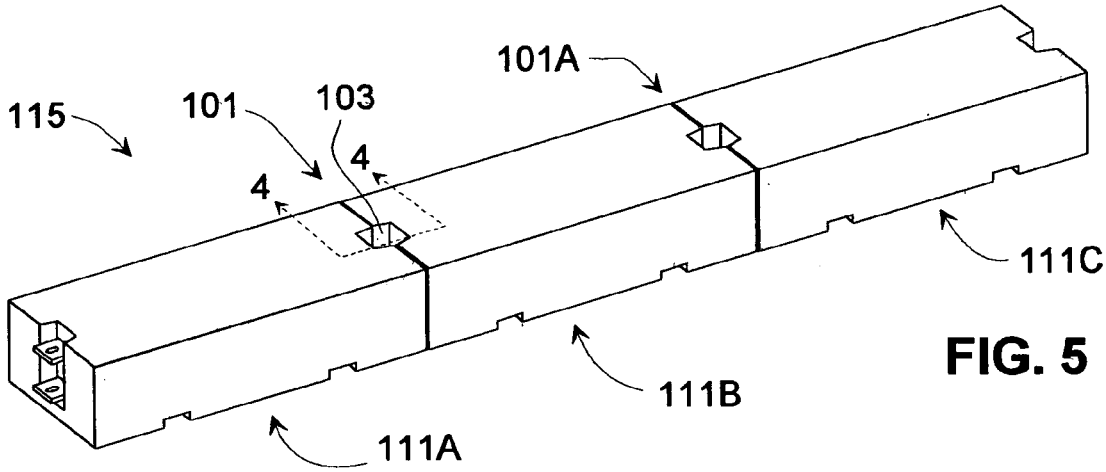
FIG. 5 shows a longitudinal row of three massive security barrier elements of the first embodiment.

In regard to FIG. 1, a first end cavity 73 is shown in the first end surface 69 situated such that the first and third tongues 24 and 27 exit the mass of solid material 47 from within the first end cavity 73. A second end cavity 75 is shown in the second end surface 71 situated such that the second and fourth tongues 25 and 28 exit the mass of solid material 47 from within the second end cavity 75. These end cavities 73 and 75 afford physical protection to the respective pairs of tongues (24, 27) or (25,28). These end cavities 73 and 75 also afford access for installation, adjustment, and removal of parts of coupling means, such as drop-pins 49 and 51, as when the barrier element 21 is placed in an end-to-end row with other similar barrier elements. An example of such a row is shown in FIG. 5).

In regard to FIG. 1, a pair of co-parallel grooves 57 and 59 is shown located in the bottom surface 63. These grooves 57 and 59 are used to receive the lifting arms of a fork-lift machine as, for example, when lifting and maneuvering the barrier element 21 during installation, adjustment, removal, loading, unloading, and storage. They also serve as passageways for passage of liquids such as rain water when the barrier element 21 is placed on a supporting surface such as a roadway, sidewalk, plaza surface, field, or campus grounds.

In regard to FIG. 1, two attachment devices 77 and 79 are shown located in the top surface 61 where rigging can be attached for lifting the barrier element 21 from above such as by a mobile hydraulic crane or other lifting machinery. These devices can, for example, be loops of steel rebar rods tied to reinforcing structure (see FIG. 15) internal to the mass of solid material 47.

In regard to FIG. 1, the mass of solid material 47 can be any dense and strong material, such as high strength concrete, that is resilient to explosive blasts and able to absorb and dissipate energy from a dynamic collision with a moving vehicle. Typical sizes for the mass of solid material range from one to four meters between the end surfaces 69 and 71, two-thirds to two meters between the top and bottom surfaces 61 and 63, and two-thirds to two meters between the front and back surfaces 65 and 67. Typical volumes of the mass of solid material 47 exceed four-ninths of a cubic meter. Typical weights of the mass of solid material 47 exceed 700 kilograms. One preferred embodiment measures approximately 3 meters between ends (length), 0.9 meters top to bottom (height), and 0.6 meters front to back (depth), for a volume of 1.62 cubic meters; for concrete with a density of 2.3 relative to water, the weight is approximately 3,800 kilograms.

In regard to FIG. 1, the mass of solid material 47 may be reinforced internally. See the discussion of FIG. 15 that describes an embodiment of structure for a typical rebar cage 161 cast within the mass of solid material 47.

In regard to FIG. 1, the tie-bars 23 and 26 can each be a single strip extending end-to-end and of any material, such as steel (preferably high-strength steel), that can withstand high tensile stresses and strains. These tie-bars 23 and 26 are preferably cast into place within the mass of solid material 47. For the example in the previous paragraph (of one preferred embodiment of a mass of solid material 47 shaped as a rectangular block having a length of approximately 3 meters, a height of 0.9 meters, and a depth of 0.6 meters), the sizes of the two tie-bars 23 and 26 can be chosen to be equal, with a corresponding length of approximately 3 meters, a height of approximately 2.5 centimeters, and a depth of approximately 15 centimeters. In other embodiments, it can be appreciated by one skilled in the art that the shapes of tie-bars (beams) 23,26 in cross-section can be any of a wide variety of shapes other than the rectangular shapes illustrated here and in the other figures, e.g. FIG. 15.

In regard to FIG. 1, one skilled in the art can readily appreciate other features of the barrier element 21. For example, the bottom surface 63 may be textured to provide a good grip on a supporting surface such as concrete pavement. The front and back surfaces 65 and 67 may be structured, textured, and finished for aesthetic purposes, for example to match surrounding architectural details of buildings and the like. The top and bottom surfaces 61 and 63 may have keying features that function as self-alignment devices and interlocking devices when stacked upon or under other barrier elements to build taller walls of barrier elements or to use storage space efficiently. The top surface 61 may have holes for supporting poles for holding such things as lighting fixtures, load speakers, and/or surveillance cameras. The back surface 67 may have built-in chases running longitudinally and/or vertically to hide and protect the passage of utility conduits such as for electrical supply for lamps. All external edges of the mass of solid material 47 can have beveled, rounded, or otherwise contoured shapes to prevent accidental breakage.

Figure 2:
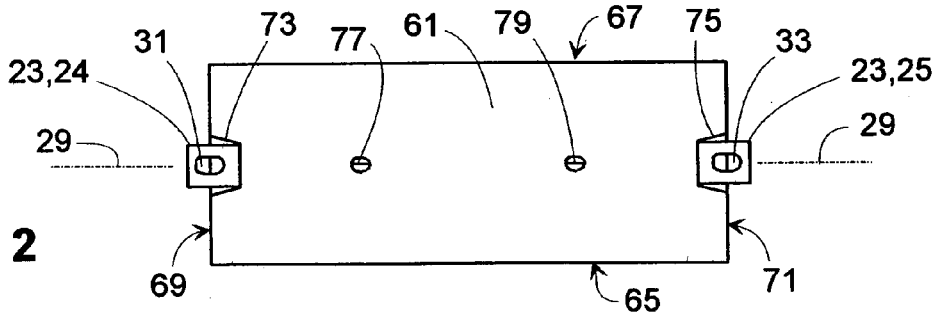
FIG. 2 shows a top view of the barrier element shown in FIG. 1.
Figure 3:
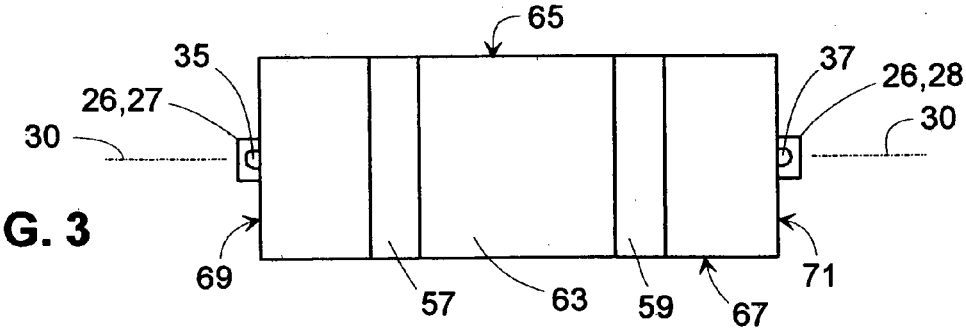
FIG. 3 shows a bottom view of the barrier element shown in FIG. 1.

FIG. 2 shows a top view of the barrier element 21 shown in FIG. 1. In this view, in contrast to what is visible in FIG. 1, the second end or tongue 25 of the first tie-bar 23 is visible along with the second attachment hole 33. The second end surface 71 and the back surface 67 are also indicated. In this view end surfaces 69 and 71 appear to bisect first and second attachment holes 31 and 33 respectively.

FIG. 3 shows a bottom view of the barrier element 21 shown in FIG. 1. In this view, in contrast to what is visible in FIG. 1, the fourth end or tongue 28 of the second tie-bar 26 is visible along with the fourth attachment hole 37. The second end surface 71 and the back surface 67 as well as the bottom surface 63 with its pair of co-parallel grooves 57 and 59 are also indicated. In this view, end surfaces 69 and 71 appear to bisect third and fourth attachment holes 35 and 37 respectively.

Figure 4:
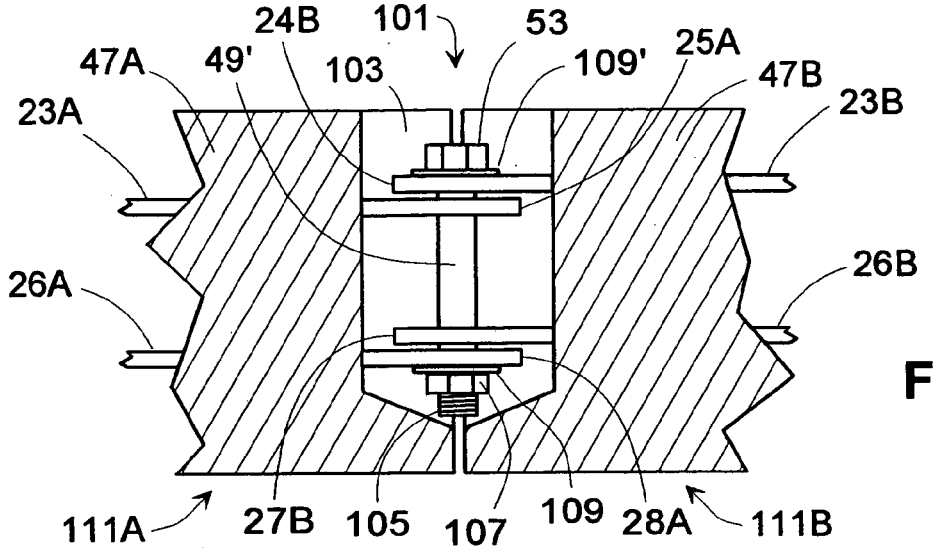
FIG. 4 is a sectional view from FIG. 5, showing a second coupling means securing together two adjacent barrier elements of the first embodiment, and where a drop-pin is used for a second coupling means. Note that the ends of the two tie-bars from the barrier element on the left-hand-side of the view are both below the ends of the two tie-bars from the barrier element on the right-hand-side.

FIG. 4 is a sectional view from FIG. 5, showing an inter-barrier coupling 101 with a first coupling means securing together two adjacent barrier elements 111A and 111B each of the first embodiment as illustrated in FIG. 1, and where an alternative embodiment of a drop-pin 49' is used. The left-hand-side of the view shows the right-hand end of the first barrier element 111A, while the right-hand-side of the view shows the left-hand end of the second barrier element 111B. The masses of solid material 47A and 47B comprising respective barrier elements 111A and 111B are also shown. Tie-bars 23A and 26A, with ends or tongues 25A and 28A respectively, are shown with the barrier element 111A. Tie-bars 23B and 26B, with ends or tongues 24B and 27B respectively, are shown with the barrier element 111B.

In regard to FIG. 4, note that ends 25A and 28A of two tie-bars 23A and 26A from the barrier element 111A on the left-hand-side of the view are both below ends 24B and 27B of two tie-bars 23B and 26B from the barrier element 111B on the right-hand-side.

In regard to FIG. 4, the drop-pin 49' is an alternative embodiment to that of the drop-pin 49 illustrated in FIG. 1. Drop-pin 49' is configured with a threaded end 105 to receive a nut 107 on the opposite to the end with the head 53, and two washers 109 and 109' are used under the nut 107 and the head 53 respectively. The drop-pin 49 passes through attachment holes (not shown) in the sequence of tie-bars 23B, 23A, 26B, and 26A.

In regard to FIG. 4, the first coupling means is comprised of the drop-pin 49' having the threads 105 and the head 53; the washers 109 and 109'; and the tie-bar ends or tongues 24B, 27B, 25A, and 28A with their respective attachment holes (not shown). FIG. 4 would illustrate a second coupling means if drop-pin 49' were replaced by the drop-pin 49 illustrated in FIG. 1, and wherein the threads 105, the nut 107, and the washers 109 and 109' would not be included.

In regard to FIG. 4, an inter-barrier cavity 103 is formed at the inter-barrier coupling 101 and protects the coupling means. An inter-barrier cavity is preferred, but not required, in all embodiments of massive security barrier elements, since they can permit access to the inter-block coupling means while adjacent blocks are pushed together end-to-end and leaving no large gap between end-to-end barrier elements.

FIG. 5 shows a barrier wall 115 illustrated as a row of three barrier elements 111A, 111B, and 111C aligned longitudinally end-to-end and coupled to form, in essence, a chain of barrier elements. A barrier wall is usually comprised of many more barrier elements in a row than illustrated in this example of just three barrier elements. In this illustration, the three massive security barrier elements 111A, 111B, and 111C are all barrier elements of the first embodiment as shown in FIG. 1. The cross-sectional view of FIG. 4 illustrates details of the coupling means at the inter-barrier coupling 101. Inter-barrier cavities are illustrated, as for example the inter-barrier cavity 103 formed between the right-hand end of barrier element 111A and the left-hand end of barrier element 111B. An identical inter-barrier coupling 101A to that of 101 is shown between barrier elements 111B and 111C.

Figure 6:
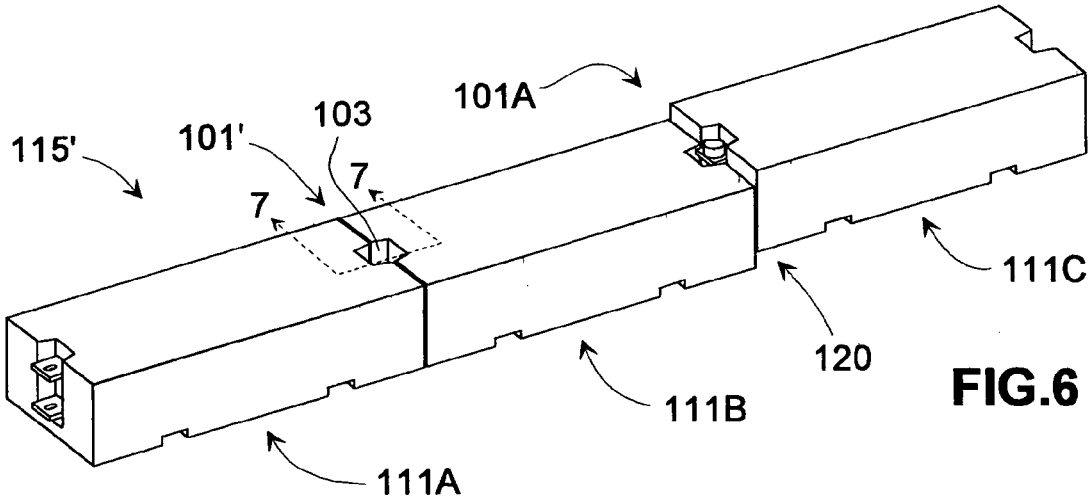
FIG. 6 shows a longitudinal row of three massive security barrier elements of the first embodiment, however one barrier element is raised from a supporting ground surface by a slight change in grade elevation. The ground is not shown but would be under the barrier elements supporting them. The raised barrier element on the far right-hand side of the view, and the neighboring barrier element (in the middle of the view) are coupled with the second coupling means. A third coupling means (different from the first) is used between the barrier element in the middle of the view and the barrier element in the left of the view, but is not shown in this figure and is shown in FIG. 7.

FIG. 6 shows a longitudinal row 115' of the same three massive security barrier elements 111A, 111B, and 111C of the first embodiment as shown in FIG. 5, however one barrier element 111C is raised from a supporting ground surface by a slight change in grade elevation 120. The ground is not shown but would be under the barrier elements supporting them. The raised barrier element on the far right-hand side of the view and the neighboring barrier element (in the middle of the view) are coupled at inter-barrier coupling 101A with the second coupling means similarly to that of the coupling 101 shown in FIG. 4. A third coupling means (different from the first and second coupling means that use drop-pins 49 and 49' respectively) is used at the inter-barrier coupling 101' within the inter-barrier cavity 103 between the barrier element 111B and the barrier element 111A, but is not shown in this figure and is shown in FIG. 7.

Figure 7:
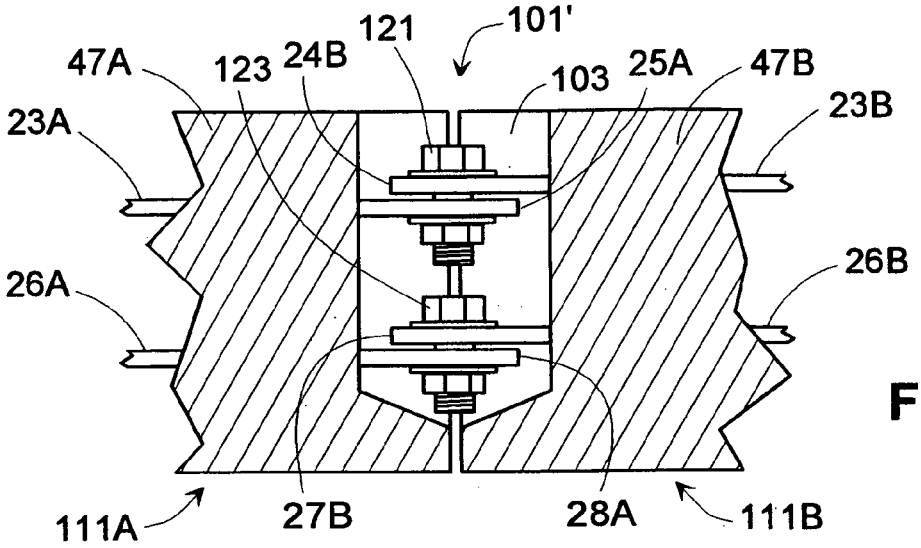
FIG. 7 is a sectional view from FIG. 6 showing a third coupling means securing together two adjacent barrier elements of the first embodiment. Note that the ends of the two tie-bars from the barrier element on the left-hand-side of the view are both below the ends of the two tie-bars from the barrier element on the right-hand-side, and that two bolts are used as part of the coupling means.

FIG. 7 is a sectional view from FIG. 6 of the inter-barrier coupling 101' and the inter-barrier cavity 103, and shows the third coupling means securing together the two adjacent barrier elements 111A and 111B of the first embodiment. This view shows the same two barrier blocks 111A and 111B as shown in FIG. 4, but coupled together with the third coupling means. Note that the ends 25A and 28A of the two respective tie-bars 23A and 26A from the barrier element 111A on the left-hand-side of the view are still (as in FIG. 4) both below the ends 24B and 27B of the two respective tie-bars 23B and 26B from the barrier element 111B on the right-hand-side of the view. This third coupling means comprises an upper bolt 121 (with nut and washers) used to coupler the pair of tie-bar ends 24B and 25A together, and a lower bolt 123 (with nut and washers) used to couple the pair of tie-bar ends 27B and 28A together.

Figure 8:
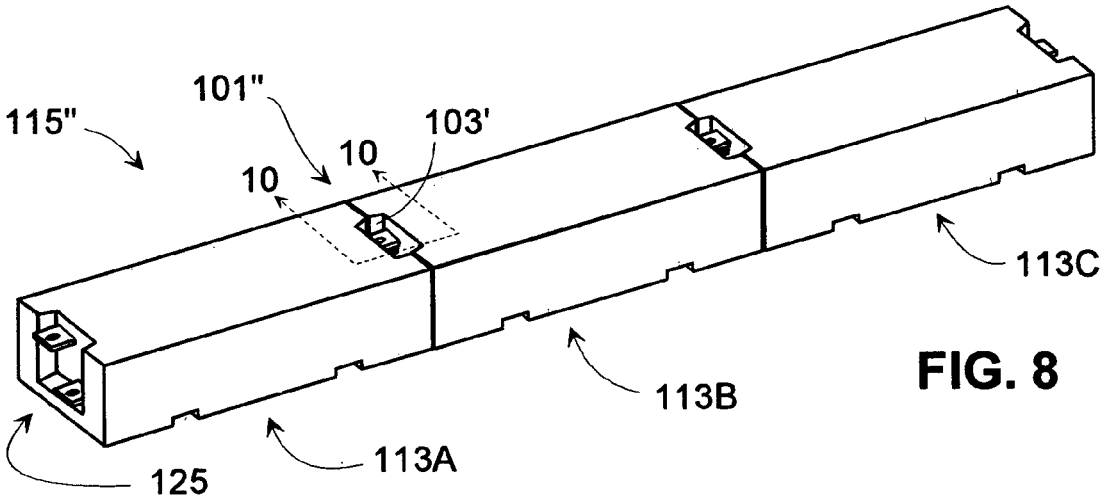
FIG. 8 shows a longitudinal row of three massive security barrier elements each of a second embodiment in which the positions of tie-bars within barrier elements are in an alternative configuration from the first embodiment. A fourth coupling means is shown as a sectional view in FIG. 10.
Figure 10:
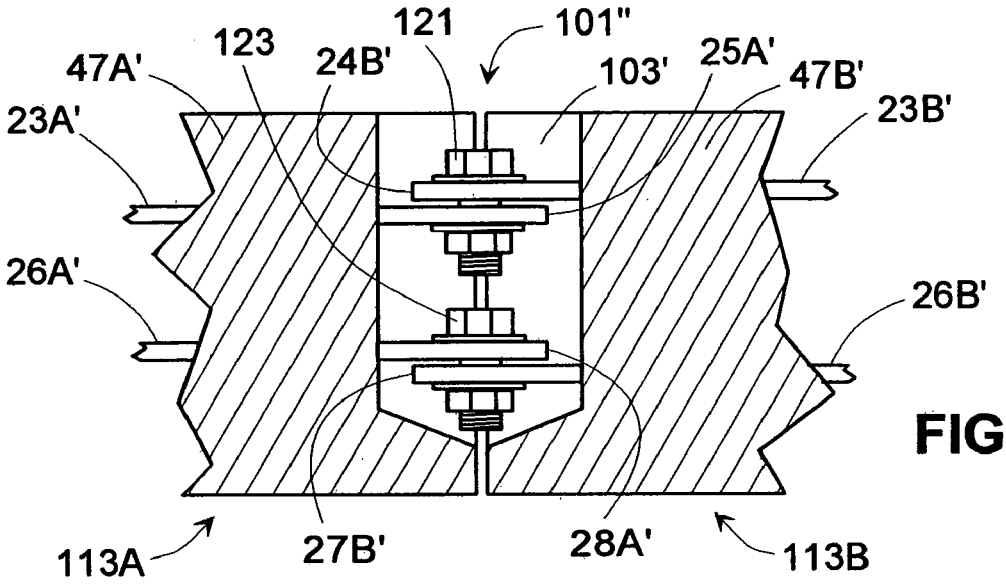
FIG. 10 is a sectional view from FIG. 8, showing a fourth coupling means securing together two adjacent barrier elements of the second embodiment. Note that in this case, the two tie-bars of the barrier element on the left-hand-side of the view both lie between the two tie-bars of the barrier element on the right-hand-side of the view, and that two bolts are used.

FIG. 8 shows a barrier wall 115" illustrated as a row of three barrier elements 113A, 113B, and 113C aligned longitudinally end-to-end. The three massive security barrier elements 113A, 113B, and 113C are all barrier elements of a second embodiment having mutually offset tie-bar locations 125. The sectional view of FIG. 10 illustrates details of a fourth coupling means at the inter-barrier coupling 101". Inter-barrier cavities are illustrated, as for example the inter-barrier cavity 103' formed between the right-hand end of barrier element 113A and the left-hand end of barrier element 113B. An identical inter-barrier coupling to that of 101" is shown between barrier elements 113B and 113C.

Figure 9:
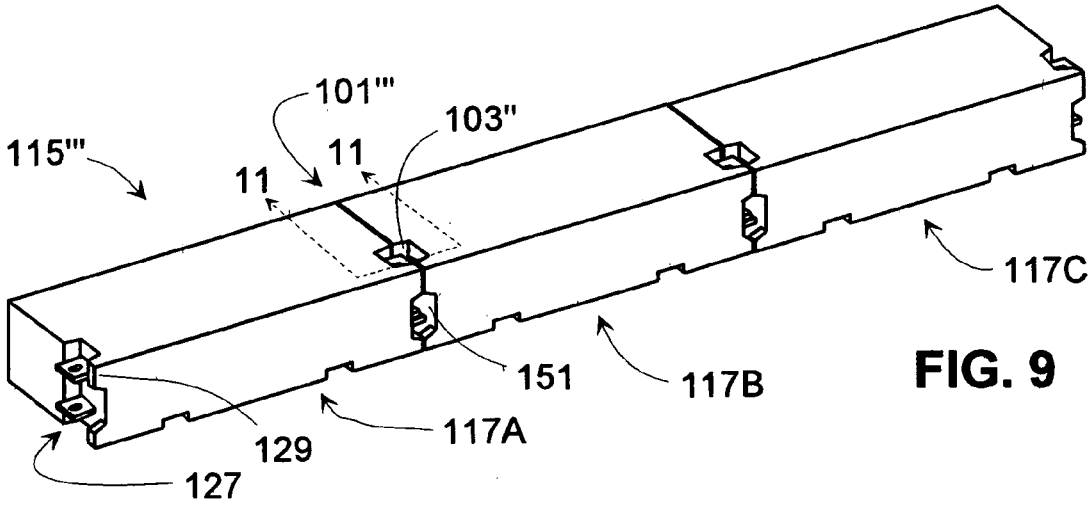
FIG. 9 shows a longitudinal row of three massive security barrier elements each of a third embodiment in which the positions of tie-bars within barrier elements are in an alternative configuration from the first embodiment. A fifth coupling means is shown as a sectional view in FIG. 11.
Figure 11:
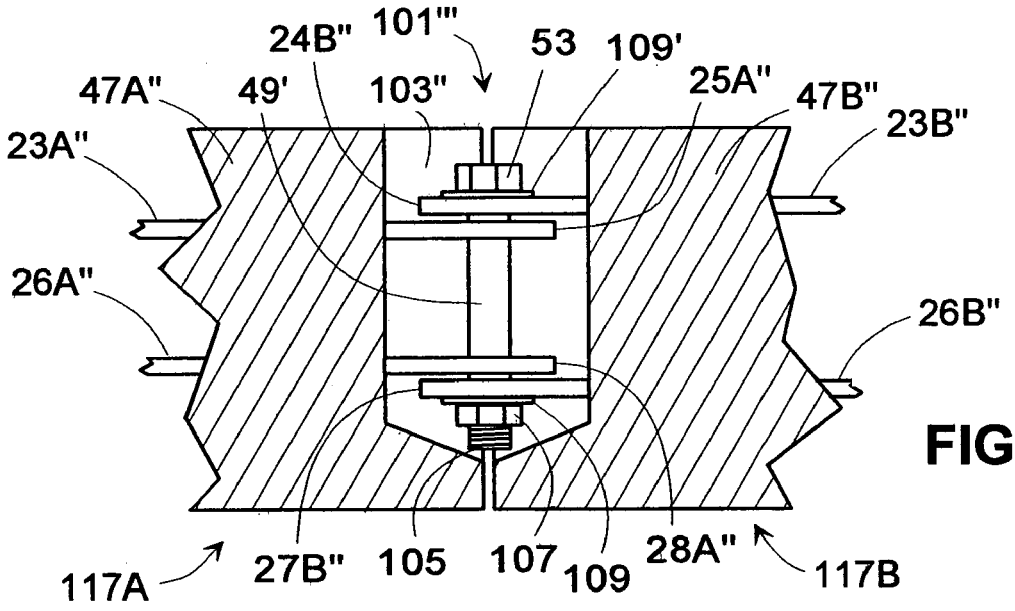
FIG. 11 is a sectional view from FIG. 9, showing a fifth coupling means securing together two adjacent barrier elements of the third embodiment. Note that in this case, the two tie-bars of the barrier element on the left-hand-side of the view both lie between the two tie-bars of the barrier element on the right-hand-side of the view, and that a drop-pin is used.

FIG. 9 shows a barrier wall 115'" illustrated as a row of three barrier elements 117A, 117B, and 117C aligned longitudinally end-to-end. The three massive security barrier elements 117A, 117B, and 117C are all barrier elements of a third embodiment having tie-bar located in a forward tie-bar location 127 such that both tie-bars are offset in the same direction away from the centered locations of the first embodiment shown in FIG. 1. The sectional view of FIG. 11 illustrates details of a fifth coupling means at the inter-barrier coupling 101'". Inter-barrier cavities are illustrated, as for example the inter-barrier cavity 103" formed between the right-hand end of barrier element 117A and the left-hand end of barrier element 117B. An identical inter-barrier coupling to that of 101'" is shown between barrier elements 117B and 117C.

In regard to FIG. 9, examples of side access openings are shown between adjacent barrier elements, such as side access opening 151 to the inter-barrier cavity 103" that lies between barrier elements 117A and 117B. Such side access openings, although not shown in illustrations of every barrier element embodiment, are possible in any of the barrier element and wall embodiments.

In regard to FIG. 9, an example is shown on the barrier element 117A of a breakable edge 129 resulting from a thin amount of the mass of solid material comprising the barrier element 117A where that material lies between the inter-barrier cavity and the front surface of the barrier element. Note how this embodiment of an end cavity runs the full height between the upper and lower surfaces of the barrier element. The existence of such a breakable edge 129 does not depend, however, on the presence of the side access opening 151.

FIG. 10 is a sectional view from FIG. 8 of the inter-barrier coupling 101" and the inter-barrier cavity 103'. FIG. 10 shows the fourth coupling means used to secure together the two adjacent barrier elements 113A and 113B of the second embodiment. The left-hand-side of the view shows the right-hand end of the first barrier element 113A, while the right-hand-side of the view shows the left-hand end of the second barrier element 113B. The masses of solid material 47A' and 47B' comprising respective barrier elements 113A and 113B are also shown. Tie-bars 23A' and 26A', with ends or tongues 25A' and 28A' respectively, are shown with the barrier element 113A. Tie-bars 23B' and 26B', with ends or tongues 24B' and 27B' respectively, are shown with the barrier element 113B. Note that the ends 25A' and 28A' of the two respective tie-bars 23A' and 26A' from the barrier element 113A on the left-hand-side of the view are both between the ends 24B' and 27B' of the two respective tie-bars 23B' and 26B' from the barrier element 113B on the right-hand-side of the view. This "between" arrangement of the tongues is what is different in the fourth coupling means compared with the "both below" arrangement shown in FIG. 7 of the third coupling means. This fourth coupling means comprises an upper bolt 121 (with nut and washers) used to coupler the pair of tie-bar ends 24B' and 25A' together, and a lower bolt 123 (with nut and washers) used to couple the pair of tie-bar ends 27B' and 28A' together.

In regard to FIG. 10, the second embodiment of barrier elements (as shown also in FIG. 8), with tie-bars mutually offset from one another in a common end cavity, enables easy access to both of the two bolts (of the fourth coupling means) with their respective nuts and washers.

FIG. 11 is a sectional view from FIG. 9 of the inter-barrier coupling 101'" and the inter-barrier cavity 103". FIG. 11 shows the fifth coupling means used to secure together the two adjacent barrier elements 117A and 117B of the third embodiment. The left-hand-side of the view shows the right-hand end of the first barrier element 117A, while the right-hand-side of the view shows the left-hand end of the second barrier element 117B. The solid masses of material 47A" and 47B" comprising respective barrier elements 117A and 117B are also shown. Tie-bars 23A" and 26A", with ends or tongues 25A" and 28A" respectively, are shown with the barrier element 117A. Tie-bars 23B" and 26B", with ends or tongues 24B" and 27B" respectively, are shown with the barrier element 117B. Note that the ends 25A" and 28A" of the two respective tie-bars 23A" and 26A" from the barrier element 117A on the left-hand-side of the view are both between the ends 24B" and 27B" of the two respective tie-bars 23B" and 26B"from the barrier element 117B on the right-hand-side of the view. This "between" arrangement of the tongues is identical to that of the fourth coupling means shown in FIG. 10. This fifth coupling means, shown here in FIG. 11, uses a drop-pin 49' as was used in the second coupling means shown in FIG. 4. The drop-pin 49' couples the pair of tie-bar ends 25A" and 28A" of barrier element 117A to the pair of tie-bar ends 24B" and 27B" of the barrier element 117B. Also as in FIG. 4, the drop-pin 49' has threads 105 at the end opposite to the head 53 and uses a nut 107 as well as washers 109 and 109'.

The embodiments illustrated in FIGS. 5, 6, 9 and their respective sectional views in FIGS. 4, 7, and 11 each show that a pair of barrier elements that are adjacent to one-another can be coupled together by an inter-barrier coupling means 101, 101', 101'" that is a coupling means for attaching the tie-bars of one of the barrier elements to tie-bars of the other of the barrier element. Observe that the coupling means in each of these illustrated embodiments enables a rotational axis axially centered within a drop-pin 49' or bolt (121 or 123). And observe that the drop-pin 49' or bolt (121 or 123) in each case is vertical and straddles a common interface plane between two oppositely facing end surfaces placed generally against one-another, i.e. leaving a gap between the oppositely facing end surfaces that is no wider than a small fraction of the diameter of the drop-pin 49' or bolt (121 or 123) used. For a perspective view of an example end surface 69, also called a side surface, see FIG. 1.

Figure 12:
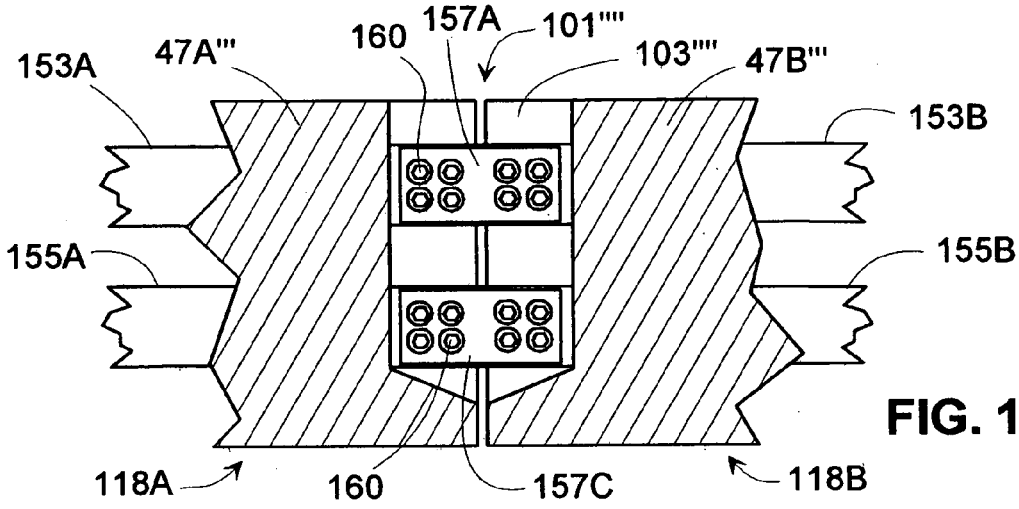
FIG. 12 is a frontal sectional view from FIG. 14, showing a sixth coupling means securing together two adjacent barrier elements of a fourth embodiment. Note that in this case, the four tie-bars (two in each barrier element) are of an alternative design and orientation to the two in the first embodiment of a barrier element. Note that the two tie-bars of the barrier element on the left-hand-side of the view each butt up against one of the two tie-bars of the barrier element on the right-hand-side view. Each pair formed as two ends butted together are sandwiched between two reinforcement plates and bolted together with multiple bolts.
Figure 13:
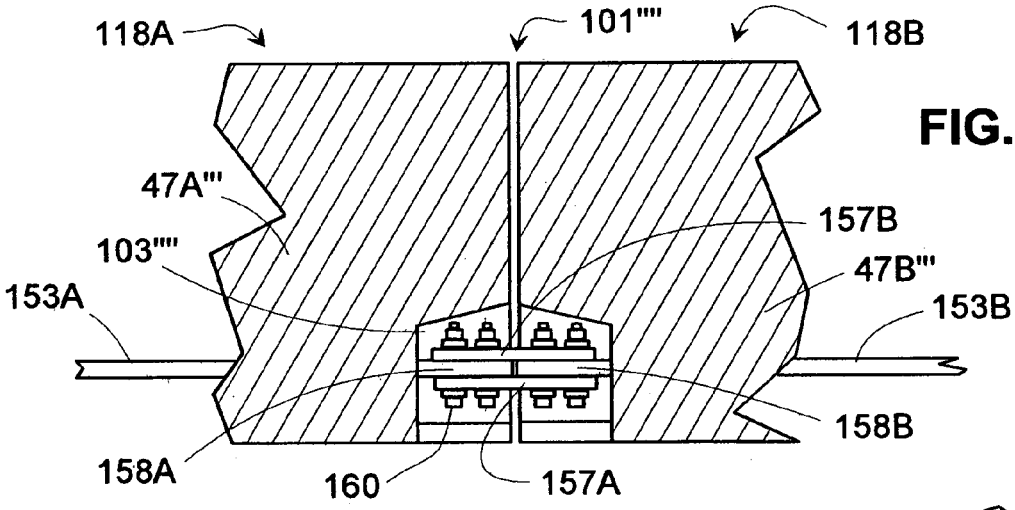
FIG. 13 is a top sectional view from FIG. 14, showing a different view of the tie-bars, reinforcement plates, and bolts holding the sandwiched structure together.
Figure 14:
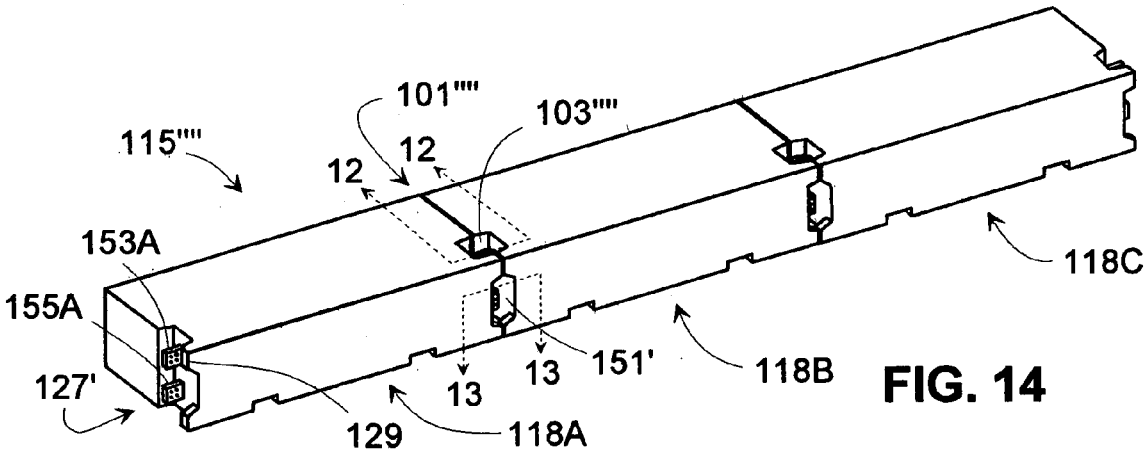
FIG. 14 shows a longitudinal row of three massive security barrier elements of the fourth embodiment coupled in a row with the sixth coupling means.

FIGS. 12 and 13 are respectively a frontal sectional view and a top sectional view (a plan view) from FIG. 14. What is shown is a sixth coupling means within an inter-barrier cavity 103"" at an inter-barrier coupling 101"" and a securing together of two adjacent barrier elements 118A and 118B of a fourth embodiment configured as having a forward tie-bar location 127' (shown in FIG. 14 and described below). In this fourth embodiment of barrier elements, the tie-bars 153A and 155A in barrier element 118A, and tie-bars 153B and 155B in barrier element 118B, have an alternative tongue design and are in orientations different from the previously described embodiments of a barrier element. The two tie-bars 153A and 155A of the barrier element 118A on the left-hand-side of the view each butt up against a respective one of the two tie-bars 153B and 155B of the barrier element 118B on the right-hand-side view. Each butted-together pair of tie-bars (153A with 153B) and (155A with 155B) is formed as two ends or tongues butted together and sandwiched between two reinforcement plates using multiple instances 160 of a fastener through holes in the reinforcement plates and tongues. In FIG. 12, reinforcement plates 157A and 157C are visible. In FIG. 13, reinforcement plates 157A and 157B are visible. Only one reinforcement plate that is used in the illustrated inter-barrier coupling is not in view, and it is the one behind the reinforcement plate 157C in FIG. 12. A portion of a mass of solid material 47A'" and 47B'" respectively comprising each of barrier elements 118A and 118B are shown hatched in cross-section. Note that an advantage of utilizing a barrier element embodiment that is compatible with the sixth coupling means described here provides that the tongues of the tie-bars need not extend beyond the end surfaces of the barrier element. This is an advantage in that it protects the tongues better during shipping, installation handling, and while storing in a distribution center or factory.

FIG. 14 shows a barrier wall 115"" illustrated as a row of three barrier elements 118A, 118B, and 118C aligned longitudinally end-to-end. The three massive security barrier elements 118A, 118B, and 118C are all barrier elements of a fourth embodiment having tie-bars located in a forward tie-bar location 127' such that both tie-bars are offset in the same direction away from the centered locations of the first embodiment shown in FIG. 1. The sectional views of FIGS.

12 and 13 illustrate details of the sixth coupling means at the inter-barrier coupling 101"". Inter-barrier cavities are illustrated, as for example the inter-barrier cavity 103"" formed between the right-hand end of barrier element 118A and the left-hand end of barrier element 118B. An identical inter-barrier coupling to that of 101"" is shown between barrier elements 118B and 118C.

In regard to FIG. 14, examples of side access openings are shown between adjacent barrier elements, such as side access opening 151' to the inter-barrier cavity 103"" that lies between barrier elements 118A and 118B. Such side access openings, although not shown in illustrations of every barrier element embodiment, are possible in any of the barrier element and wall embodiments.

In regard to FIG. 14, an example is shown on the barrier element 118A of a breakable edge 129 resulting from a thin amount of the mass of solid material comprising the barrier element 118A where that material lies between the inter-barrier cavity and the front surface of the barrier element. Note how this embodiment of an end cavity runs the full height between the upper and lower surfaces of the barrier element. The existence of such a breakable edge 129 does not depend, however, on the presence of the side access opening 151.

In regard to FIG. 14, the locations and orientations of the upper tie-bar 153 and the lower tie-bar 155 in the forward direction with this fourth embodiment, and the rigidly interconnected tie-bars from barrier element to barrier element in this sixth coupling means, cause the barrier wall 115"" to experience lower tensile stresses across the couplings and absorb more energy by bending and therefore hinging (rotating) at the couplings, as breakable edge 129 gives way, than in any of the earlier described barrier element embodiments with the earlier described coupling means.

Figure 15:
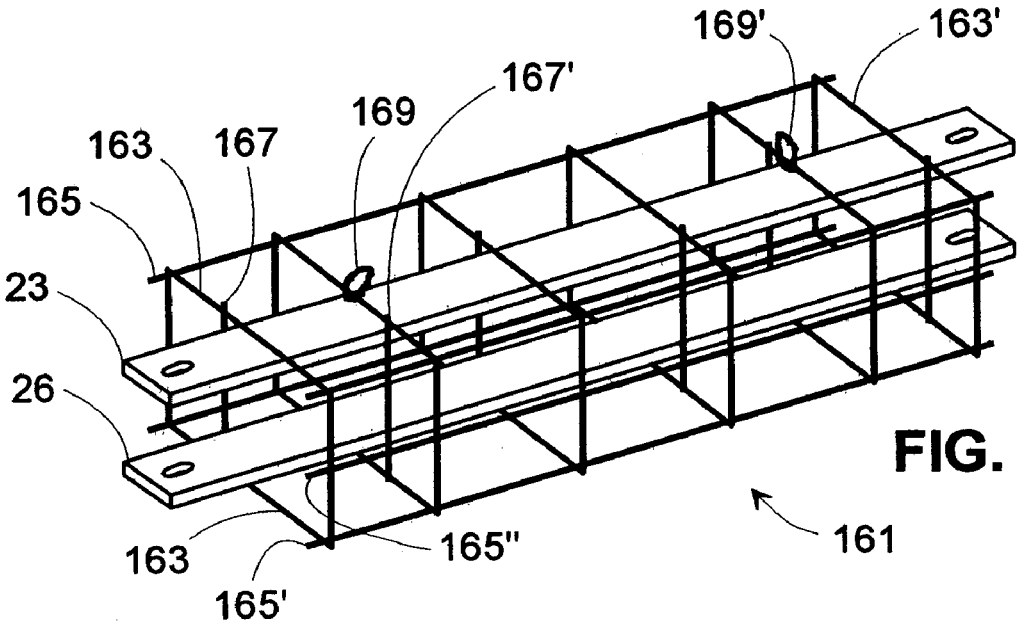
FIG. 15 shows an embodiment for the structure of a rebar cage surrounding a pair of tie-bars, wherein the tie-bars are shown, only for an example, in the arrangement used with barrier elements of the first embodiment. The rebar cage, two lifting loops also formed of rebar, and all except end portions of the tie-bars would be cast within a mass of solid material to form a barrier element.

FIG. 15 shows an embodiment for the structure of a rebar cage 161 surrounding a pair of tie-bars 23 and 26. The tie-bars 23 and 26 are shown, only for an example, in the arrangement as used with the barrier element 21 of the first embodiment. Note that each of the tie-bars 23 and 26 is illustrated here as a straight single bar of solid construction with a generally rectangular cross-section and with an attachment hole near each end. The rebar cage 161, two lifting loops or rebar attachment tie-ins 169, and all except end portions or tongues of the tie-bars would be cast within a mass of solid material to form a barrier element. This example of a rebar cage 161, used to strengthen an enveloping mass of solid material (stripped away for better illustration purposes and not shown), is shown comprised of a series of co-parallel loops 163. The callout numbers 163 indicate top and bottom portions one such loop 163 situated nearest the ends or tongues of the two tie-bars 23 and 26 where they extend into the left-hand-side of the view. The callout number 163' indicates a like rebar loop 163' situated nearest the ends or tongues of the tie-bars 23 and 26 where they extend into the right-hand-side of the view. Interconnecting all of the rebar loops (such as 163) are six horizontal lengths of rebar, such as 165, 165', and 165". Rebar horizontals 165 and 165', for example, are those located in two diagonally opposite corners of the rectangular-shaped rebar loops (such as 163). Rebar horizontal 165" is an example of a rebar horizontal located mid-way between two adjacent corners of the rectangular-shaped rebar loops (such as 163). Six rebar verticals such as 167 and 167' are attached to the rebar loops 163 and to the tie-bars 23 and 26 primarily to support those tie-bars 23 and 26 when they are cast with the rebar cage 161 into a mass of solid material such as high-strength concrete.

In regard to FIG. 15, rebar attachment tie-ins 169 and 169' are shown tied in to the rebar cage 161 at midpoints to the top portions of two of the multiple rebar loops 163. These serve as conveniently structured locations to which to attach lifting apparatus before or after encasing the whole assembly into a mass of solid material comprising a massive barrier element.

Figure 16:
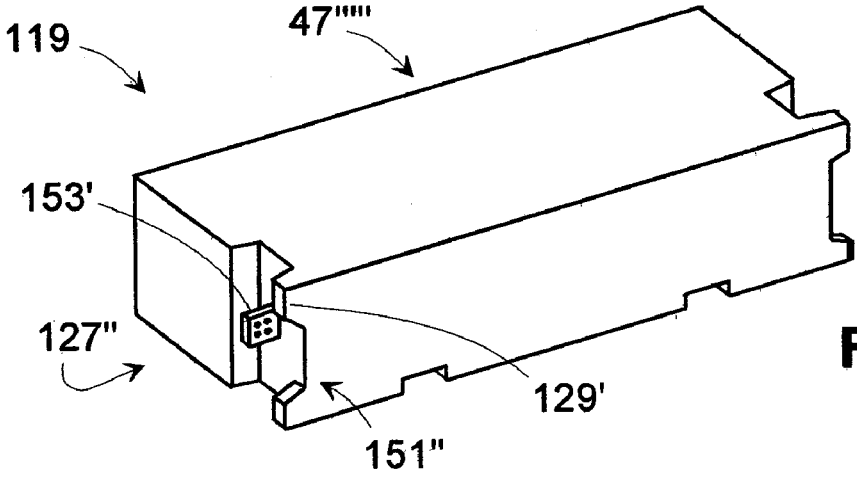
FIG. 16 shows a massive security barrier element of a fifth embodiment in which a single tie-bar is included, and in which the single tie-bar has coupling features and an orientation similar to that used in the fourth embodiment.

FIG. 16 shows a massive security barrier element 119 of a fifth embodiment in which a single tie-bar 153' is included and located in a forward tie-bar location 127", and in which the single tie-bar 153' has coupling features and an orientation similar to that used in the fourth embodiment shown in FIGS. 12, 13, and 14 but located midway between the two tie-bars 153A and 155A shown in those FIGS. 12 and 14. Having only a single tie-bar rather than two, this fifth embodiment is less able to share rolling torques with its neighboring barrier elements, although this shortcoming can be overcome by increasing the height of the single tie-bar 153'. Also shown are a breakable edge 129' and a side-access opening 151". A mass of solid material 47"" is also shown surrounding the mid-portion of the tie-bar 153', i.e. all but the ends or tongues.

Figure 17:
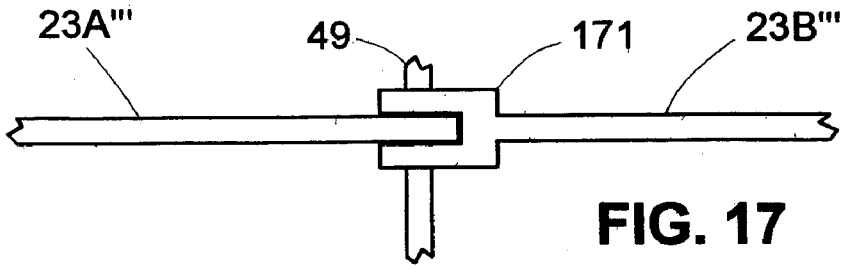
FIG. 17 shows a seventh coupling means wherein two tie-bars are compatibly shaped for being joined together in a symmetrical configuration that can minimize the opportunity for tension forces in the tie-bars to create bending forces on a coupling pin or bolt.

FIG. 17 shows a seventh coupling means wherein two tie-bars 23A"' and 23B"' are coupled with the first drop-pin 49. The coupled ends shown of the two tie-bars 23A"' and 23B"' are compatibly shaped for being joined together in a symmetrical configuration that can minimize the opportunity for tension forces in the tie-bars to create bending forces on the coupling drop-pin 49 or alternatively on a coupling bolt. To achieve symmetry, the end of the tie-bar 23"' is fitted with a y-branched structure or otherwise symmetrical end 171.

One skilled in the art will appreciate that other coupling means and arrangements of one or more tie-bars in massive barrier elements can be implemented as well, and that shapes for the mass for solid material comprising a barrier element can be other than the rectangular blocks illustrated in this specification.

Although the invention is described with respect to preferred embodiments, modifications will be apparent to those skilled in the art. Therefore, the scope of the invention is to be determined by reference to the claims that follow.

I claim:

1. A method for providing protection from a terrorist threat, the method comprising the steps of:

a) providing multiple barrier elements each comprising a mass of solid material that comprises two opposite sides, wherein each of said barrier elements includes at least one tie-bar that has two opposite ends and that extends through its mass of solid material from one side of its barrier element to its opposite side, wherein a mid-portion of the tie-bar is cast within the solid material, wherein each end of the tie-bar extends through a cavity in a respective one of the sides, wherein each barrier element is alignable side-against-side in a continuous row with another of the barrier elements, and wherein each pair of barrier elements that are to be aligned adjacent to one-another then forms an adjacent pair;

b) providing at least one respective coupling means, for each of said adjacent pairs, for rotatably attaching at least the one tie-bar of one of the barrier elements of the adjacent pair to a respective at least one tie-bar of the other barrier element of the adjacent pair end-to-end to form a coupled pair of tie-bars; and c) aligning said adjacent pairs and installing each of said respective coupling means to form said continuous row between an expected safe side and a threat side;

wherein the coupling means and the coupled ends of tie-bars are generally hidden within the cavities from being exposed to blast products from a terrorist's explosion; and wherein each of said coupled pairs of tie-bars has sufficient strength that two adjacent barrier elements rotate relative to one-another as they slide and remain coupled when there is sufficient external force from terrorist acts to break the solid material of the two adjacent barrier elements where the solid material interferes with rotation.

2. The method of claim 1 for providing protection from a terrorist threat, wherein each of a pair of the sides that are against one-another between said adjacent barrier elements includes a generally planar surface that extends generally parallel and oppositely facing to a generally planar surface of the other of the pair of sides, and extends both toward a front and toward a back of said barrier elements.

3. A security wall segment comprising:

a) a first massive security barrier element, for deterring terrorists, comprised of a first tie-bar and a second tie-bar each cast within a first mass of solid material, wherein at least a portion of each of the tie-bars has a rectangular cross-section, wherein each of said first and second tie-bars have two opposite exposed ends extending outward from respectively two cavities within respectively two generally planar side surfaces of said first mass of solid material, wherein each of the exposed ends has a hole with an approximately vertical hole axis that lies at least partially and approximately coincident with its respective generally planar side surface, and wherein the first barrier element is slidable;

b) a second massive security barrier element, for deterring terrorists, comprised of a third tie-bar and a fourth tie-bar each cast within a second mass of solid material and each of the tie-bars having a rectangular cross-section, wherein each of said third and fourth tie-bars have two opposite exposed ends extending outward from respectively two cavities within respectively two generally planar side surfaces of said second mass of solid material, wherein each of the exposed ends has a hole with an approximately vertical hole axis that lies at least partially and approximately coincident with its respective generally planar side surface, and wherein the second barrier element is slidable; and c) coupling means for attaching said first and second tie-bars respectively to said third and fourth tie-bars, wherein said coupling means provides rotatable coupling between the first and second barrier elements about a rotational axis that is at least approximately coincident with at least one of said approximately vertical hole axes from the first barrier element and at least one of said approximately vertical hole axes from the second barrier element, and wherein said coupling means and the tie-bars are of sufficient strength to remain attached during rotation of the first barrier element relative to the second barrier element;

wherein at least the tie-bars remain within most of the masses of solid material and remain attached by the coupling means after at least one of the massive security barrier elements is subjected to external impulsive forces sufficiently strong to rotate the modules relative to each other causing at least some of the solid material that structurally interferes with that rotation to break.

4. The security wall segment of claim 3, further including additional massive security barrier elements.

5. The security wall segment of claim 3, wherein the holes at the exposed ends of at least one of the tie-bars are within a strip of steel extending continuously between them.

6. The security wall segment of claim 3, wherein the masses of solid material are masses of concrete.

7. The security wall segment of claim 3, wherein each of said first and second massive security barrier elements includes a bottom surface that is slidable, a front surface, and a back surface.

8. The security wall segment of claim 3, wherein said coupling means hinges horizontally when at least one selected from the group consisting of a terrorist vehicle and an explosive blast strikes at least one selected from the group consisting of at least one of said front surfaces and at least one of said back surfaces.

9. The security wall segment of claim 3;

wherein at least one approximately vertical edge is formed between a front surface and a side surface on the first barrier element; and wherein said approximately vertical edge is damaged by rotation when at least one selected from the group consisting of a terrorist vehicle and an explosive blast strikes at least one of said front surfaces.

10. A massive security barrier module comprising:

a) a mass of solid material having a slidable bottom surface, wherein the mass has two opposite sides, a front, and a back, wherein each side has a front edge near the front, and wherein each side has a back edge near the back;

b) at least two tie-bars cast within the mass, wherein each of said at least two tie-bars extends through the mass and into a respective cavity in each of said two opposite sides; and c) a coupling means for attaching said at least two tie-bars to other tie-bars of an adjacent mass of a similar massive security barrier module, wherein the coupling means has an axis of rotation that lies generally between the front edge and the back edge of one of the sides, wherein the axis is at least partially and approximately coincident with one of said two opposite sides, and wherein the coupling means and tie-bars are of sufficient strength to remain attached under rotation of the coupling means;

wherein the massive security barrier module has sufficient strength to maintain attachment with the similar massive security barrier module, and the axis remain at least partially and approximately coincident with said one of said two opposite sides, when at least one of the massive security barrier modules is subjected to an external impulsive force from a terrorist act sufficiently strong to rotate the modules relative to one another and cause at least one of the edges that structurally interferes with that rotation to break;

whereby energy from a security-threat event is absorbed by the break and further attenuated by the mass sliding across the ground.

11. A first massive security barrier element comprising:

a) a first mass of solid material, wherein the mass has a slidable bottom surface, has at least a first cavity within a first side surface, and has a second cavity within a second side surface, wherein said first side surface is generally planar defining a first planarity plane, wherein said second side surface is generally planar defining a second planarity plane, and wherein the first and second side surfaces are at least approximately perpendicular to the bottom surface;

b) a first tie-bar having a first end and a second end defining a first longitudinal axis of elongation, wherein said first tie-bar has a first mid-portion between said first end and said second end, wherein said first tie-bar is penetrated near said first end by at least a first attachment hole having a first hole axis, wherein said first tie-bar is penetrated near said second end by at least a second attachment hole having a second hole axis, and wherein said first hole axis and said second hole axis are both oriented at least approximately perpendicular to the first longitudinal axis; and c) a second tie-bar having a third end and a fourth end defining a second longitudinal axis of elongation, wherein said second tie-bar has a second mid-portion between said third end and said fourth end, wherein said second tie-bar is penetrated near said third end by at least a third attachment hole having a third hole axis, wherein said second tie-bar is penetrated near said fourth end by at least a fourth attachment hole having a fourth hole axis, and wherein said third hole axis and said fourth hole axis are both oriented at least approximately perpendicular to the second longitudinal axis;

wherein said first mid portion and said second mid portion are cast within said first mass of solid material;

wherein at least said first mid portion is that of a straight single bar of solid construction;

wherein said first end is spaced apart by a spacing distance from said third end at least in a direction at least approximately perpendicular to said bottom surface;

wherein said second end is spaced apart by approximately the same spacing distance from said fourth end at least in a direction at least approximately perpendicular to said bottom surface;

wherein at least said first tie-bar penetrates both said first cavity and said second cavity and extends beyond the planarity planes defined by the first and second side surfaces;

wherein the first and third hole axes are at least approximately co-incident and form a first axis of rotation that is at least approximately coincident with the first planarity plane;

wherein the second and fourth hole axes are at least approximately co-incident and form a second axis of rotation that is at least approximately coincident with the second planarity plane; and wherein the first and second axes of rotation are for hinged attachment side-against-side of the first massive security barrier element to adjacent and similar massive security barrier elements to form a security barrier having sufficient strength and mass collectively to stop a terrorist vehicle in a short distance of sliding, to absorb energy in breaking solid material that interferes with rotation, and to prevent a terrorist blast from breaking the elements loose from each other.

12. The first massive security barrier element of claim 11;

wherein said first tie-bar is a bar of generally rectangular cross-section and is elongated from said first end to said second end in a direction generally parallel to said first longitudinal axis of elongation; and wherein said second tie-bar is a bar of generally rectangular cross-section and is elongated from said third end to said fourth end in a direction generally parallel to said second longitudinal axis of elongation.

13. The first massive security barrier element of claim 11, wherein the first and second tie-bars are comprised of steel, and wherein said first mass of solid material is comprised of concrete.

14. The first massive security barrier element of claim 11, further comprising:

a rebar cage within said first mass of solid material;

wherein said rebar cage encircles said first and second tie-bars; and wherein said rebar cage provides strength to said first mass of solid material;

whereby the first mass of solid material affords protection to said first and second tie-bars.

15. The first massive security barrier element of claim 11, wherein said first mass of solid material includes a front surface and a back surface, and wherein said first mass of solid material has a size that is two-thirds to two meters as measured between the front and back surfaces.

16. The first massive security barrier element of claim 11, wherein said first mass of solid material weighs greater than seven hundred kilograms.

17. The first massive security barrier element of claim 11;

wherein said first mass of solid material includes a front surface and a back surface;

wherein said front and back surfaces are generally and at least approximately co-parallel;

wherein said first and second longitudinal axes are oriented generally and at least approximately parallel to said front and back surfaces; and wherein said bottom surface is generally planar.

18. The first massive security barrier element of claim 17, further comprising:

a) coupling means for attaching said second end of said first tie-bar rotatably to a first end of another first tie-bar of a second massive security barrier element similar to the first barrier element to form a coupled pair of adjacent barrier elements each having their respective mass of solid material with their respective front surface and their respective back surface; and b) breakable vertical edges of each of the masses of solid material, wherein the edges are at least approximately vertical and are situated at each intersection of one of its side surfaces with one selected from the group consisting of its respective front surface and its respective back surface;

wherein the attached tie-bars are coupled with sufficient strength to remain attached when rotation of the first barrier element relative to the second barrier element causes at least some of the solid material to break;

whereby the coupling means and the breakable vertical edges allow said second massive security barrier element to rotate horizontally relative to said first massive security barrier element and about the second axis of rotation of said first massive security barrier element; and whereby horizontal rotation can occur while the tie-bars, together with their coupling means, remain intact after at least one of the coupled pair of adjacent barrier elements is struck by a colliding vehicle or exposed to energy from a nearby explosive blast.

19. The first massive security barrier element of claim 18;

wherein said first and second massive security barrier elements and said coupling means are topside of a ground surface;

whereby said first and second massive security barrier elements and said coupling means cannot endanger any underground utilities.

20. The first massive security barrier element of claim 18, wherein the coupling means includes a drop-pin extended through at least said second and fourth attachment holes.

21. The first massive security barrier element of claim 18; wherein the coupling means includes a bolt and a nut; and wherein said bolt extends through at least said second attachment hole of said first massive security barrier element and said first attachment hole of said second massive security barrier element.

22. A security wall comprising:

a) a row of massive security barrier elements that are slidable, wherein each of the barrier elements comprises at least two tie-bars and a mass of solid material that has two opposite and generally planar sides, wherein the mass of solid material of each of the barrier elements is cast about its respective two tie-bars, wherein each of the respective two tie-bars extends between the two generally planar sides of its corresponding mass of solid material, wherein each adjacent pair of these barrier elements has two oppositely-facing generally planar sides located against one-another defining a common interface plane that is penetrated by each of the respective two tie-bars, and wherein each tie-bar that penetrates the interface plane is positioned partially within a pair of oppositely facing cavities that are respectively in the oppositely-facing generally planar sides; and b) for each adjacent pair of barrier elements, a coupling means for attaching the tie-bars of one of the pair of barrier elements to respective tie-bars of the other of the pair of barrier elements to establish an approximately vertical axis of hinged rotation, wherein the vertical axis is at least partially and approximately coincident with the respective interface plane;

wherein the oppositely-facing generally planar sides located against one-another, together with the oppositely facing cavities that are respectively in the oppositely-facing generally planar sides, form a generally closed structure that hides and protects the included coupling means;

wherein the strengths of the tie-bars and the coupling means are sufficient to withstand relative rotation between barrier elements of at least one of the adjacent pairs of barrier elements when the security wall is stuck by one selected from the group consisting of a terrorist vehicle and a terrorist explosion; and wherein solid material of at least one of the generally planar sides breaks under said rotation.

23. The security wall of claim 22, wherein at least a portion of one of the tie-bars is a beam of rectangular cross-section comprised of a single longitudinal strip of high-strength steel extending at least all the way between the two generally planar sides corresponding to one of the masses of solid material.

24. A method for assembly of a coupled pair of adjacent massive security barrier elements comprising the steps of:

a) providing a pair of adjacent massive security barrier elements, wherein each element is comprised of a respective mass of solid material comprised of two opposite sides and a slidable bottom surface, wherein each of the sides of each element is comprised of two opposite edges, wherein each element is comprised of a tie-bar partially encased within the respective mass of solid material and extending from one of the two opposite sides to the other of the two opposite sides of the respective mass of solid material, wherein the tie-bar of each element is located between the two opposite edges of each of the two opposite sides of the respective mass of solid material, and wherein the tie-bar of each element extends beyond the two opposite sides of the respective mass of solid material from respective cavities in the two opposite sides of the respective mass of solid material;

b) providing a coupling means for attaching the tie-bar of one of the adjacent elements rotatably to the tie-bar of the other of the adjacent elements while the adjacent elements are located side-against-side; and c) using the coupling means to attach the two elements together rotatably side-against-side forming a coupled pair of adjacent massive security barrier elements and a coupled pair of tie-bars sufficiently strong to maintain attachment under rotation of one of the adjacent elements relative to the other element;

wherein rotation between the elements of the coupled pair requires a sufficiently strong force to overcome compressive strength of at least some of the solid material and cause that some of the solid material to fail near at least one of the edges; and wherein the tie-bars remain coupled, when sustaining said rotation, and collectively provide a barrier to terrorist threats.

25. The method of claim 24 for assembly of a coupled pair of adjacent massive security barrier elements, further comprising the steps of:

a) providing an additional massive security barrier element similar to one of the coupled pair;

b) providing an additional coupling means similar to that coupling the coupled pair;

c) using the additional coupling means to attach the additional element rotatably to one other of the barrier elements that hasn't been coupled twice; and d) repeating the previous three steps at least one time.

26. A method for assembling and using a coupled pair of slidable massive security barrier elements comprising the steps of:

a) identifying what is to be a safe side opposite to a threat side, said safe side to be protected by a row of the barrier elements from at least one selected from the group consisting of a terrorist's vehicle and a terrorist's explosive;

b) providing slidable massive security barrier elements each having a respective mass of solid material with respective two opposite sides, each side bounded by at least a vertical edge, each of the elements having at least two tie-bars partially encased within its respective mass, each tie-bar extending between and through the two opposite sides of the respective mass, and each tie-bar having two opposite ends with a hole in each end, wherein each of the holes has an approximately vertical hole axis at least partially and approximately coincident with a side; and c) placing the barrier elements adjacent to one-another to form the row and coupling them with one of the group consisting of a drop-pin and a bolt extending through at least two of the holes, wherein a gap between the barriers is smaller than a diameter of the drop-pin or bolt;

wherein rotation between the barrier elements of the coupled pair requires a sufficiently strong external force to overcome compressive strength of at least some of the solid material and cause that some of the solid material to fail near at least one of the vertical edges; and wherein the barrier elements remain coupled, when sustaining said rotation, and collectively provide a barrier to terrorist threats.

27. A method for assembling and using a massive security barrier wall comprising the steps of:

a) providing a location for the wall where one side of the wall is to be a safe side and an opposite side of the wall is allowed to be a threat side, wherein the safe side provides protection from at least one selected from the group consisting of a terrorist's vehicle on the threat side and a terrorist's explosive on the threat side;

b) providing multiple massive security barrier elements each having a respective mass of solid material with respective two opposite sides and a slidable bottom surface, each side bounded by at least a vertical edge, each element having at least two tie-bars encased within its respective mass of solid material and extending between and through its opposites sides, and each tie-bar having two opposite ends and a hole near each end, wherein each of the holes has an approximately vertical hole axis at least partially and approximately coincident with a side; and c) arranging the barrier elements into a row at said location to form the wall, and using one of the group consisting of drop-pins and bolts to couple tie-bars of adjacent barrier elements, wherein gaps between masses of solid material that are adjacent to one-another are somewhere less than a smallest width of the holes so used;

wherein rotation between the barrier elements requires a sufficiently strong external force to overcome compressive strength of at least some of the solid material and cause that some of the solid material to fail near at least one vertical edge; and wherein the barrier elements remain coupled, when sustaining said rotation, and collectively provide a barrier to terrorist threats.

28. A massive security barrier wall comprising:

a) a pair of massive security barrier elements each comprising:

i) a mass of solid material having a slidable bottom surface and two side surfaces having at least one vertical edge, wherein the side surfaces are spaced apart to define a length of the mass;

ii) at least one rectangular-cross-sectioned tie-bar extending through the mass at least from one side surface to the other side surface;

b) a coupling means for coupling an end portion of the tie-bar of one of the barrier elements to an end portion of the tie-bar of the other barrier element such that one of the sides of one of the masses is at least approximately against a side of the other of the masses;

wherein the coupling means enables an initial hinged rotation of one barrier element relative to the other barrier element of more than a nominal amount only when sufficiently strong external forces cause at least some of the mass of solid material to break under compression about the edges; and wherein the tie-bars are of sufficient strength to remain coupled during said rotation, thereby maintaining a barrier to terrorist threats.

29. A method for using a massive security barrier element comprising the steps of:

a) identifying a safe side to be protected from at least one selected from the group consisting of a terrorist's vehicle on a threat side and a terrorist's explosive event on a threat side;

b) providing a slidable massive security barrier element having a mass of solid material, having at least one tie-bar extending through two opposite and co-parallel sides of the mass, and having a hole in each of two ends of the tie-bar, wherein each of the holes has an approximately vertical hole axis at least partially and approximately coincident with a respective one of the sides enabling hinged attachment to another tie-bar in a similar and adjacent massive security barrier element;

c) using a means for attaching the one tie-bar to said another tie-bar hingedly; and d) placing the element side-against-side with said similar and adjacent massive security barrier element and between the safe side and the threat side to anticipate a sliding distance of the element along with the adjacent element;

wherein the tie-bars and the means for attachment are protected from a terrorist's explosive blast by at least partial encasement within the solid material; and wherein both the means for attachment and the tie-bars are strong enough to remain attached to each other when rotation of the element relative to the adjacent element is forced by one selected from the group consisting of a collision with a terrorist vehicle and a blast from a terrorist explosion, causing solid material to break where the solid material interferes with the rotation.

* * * * *